US011225792B2

(12) United States Patent
Robak

(10) Patent No.: US 11,225,792 B2
(45) Date of Patent: Jan. 18, 2022

(54) INSULATING CONSTRUCTION PANELS, SYSTEMS AND METHODS

(71) Applicant: Edward Robak, Dix Hills, NY (US)

(72) Inventor: Edward Robak, Dix Hills, NY (US)

( * ) Notice: Subject to any disclaimer, the term of this patent is extended or adjusted under 35 U.S.C. 154(b) by 0 days.

(21) Appl. No.: 15/588,578

(22) Filed: May 5, 2017

(65) Prior Publication Data

US 2019/0093348 A1 Mar. 28, 2019

Related U.S. Application Data

(60) Provisional application No. 62/391,636, filed on May 5, 2016.

(51) Int. Cl.

| | |
|---|---|
| ***E04B 2/26*** | (2006.01) |
| ***E04B 2/18*** | (2006.01) |
| ***E04B 2/86*** | (2006.01) |
| ***E04B 1/16*** | (2006.01) |
| ***E04B 1/94*** | (2006.01) |
| *E04B 2/16* | (2006.01) |

(52) U.S. Cl.

CPC ..... *E04B 2/8652* (2013.01); *E04B 1/167* (2013.01); *E04B 1/942* (2013.01); *E04B 2/16* (2013.01); *E04B 2/18* (2013.01); *E04B 2/26* (2013.01); *E04B 2002/867* (2013.01)

(58) Field of Classification Search

CPC ..... E04B 2/26; E04B 2/16; E04B 2/18; E04B 2002/867; E04B 2/08; E04B 2/04; E04B 2002/0297; E04B 2002/0243; E04B 2/8652; E04B 1/167; E04B 1/942

See application file for complete search history.

(56) References Cited

U.S. PATENT DOCUMENTS

| | | | | |
|---|---|---|---|---|
| 738,643 | A | 9/1903 | Van Camp | |
| 3,428,933 | A * | 2/1969 | Egon | G01L 1/2287 156/241 |
| 4,884,382 | A | 12/1989 | Horobin | |
| 5,428,933 | A | 7/1995 | Philippe | |
| 5,465,542 | A | 11/1995 | Terry | |

(Continued)

*Primary Examiner* — Phi D A

(74) *Attorney, Agent, or Firm* — Law Office of Richard F. Jaworski, PC

(57) ABSTRACT

An insulated construction panel having a top end, a bottom end, a first end, a second end, a front side and a rear side, the panel for constructing a single or multi-thickness concrete form, the panel including regularly spaced coplanar passages extending completely through the panel from the top end of the panel toward and through to the bottom end of the panel. For each of the regularly spaced coplanar passages, an angular passage perpendicularly intersecting each coplanar passage at the top end and extending toward and through a portion of a front side surface of the front side and rear side surface of the rear side of the panel, each angular passage extending only partially through the panel from the top end toward the bottom end. For each of the regularly spaced coplanar passages, an angular passage perpendicularly intersecting each coplanar passage at the bottom end and extending toward and through a portion of the front side surface of the front side and the rear side surface of rear side of the panel, each angular passage extending only partially through the panel from the bottom end toward the top end.

20 Claims, 28 Drawing Sheets

(56) References Cited

U.S. PATENT DOCUMENTS 5,557,894 A * 9/1996 Card ..... E06B 1/6007 52/204.5
5,566,521 A 10/1996 Andrews et al.
5,625,989 A 5/1997 Brubaker et al.
5,704,180 A 1/1998 Boeck
5,729,936 A 3/1998 Maxwell
6,108,990 A * 8/2000 Klamer ..... E04F 13/04 52/100
6,318,041 B1 11/2001 Stanley
6,526,710 B1 3/2003 Killen
6,601,356 B2 * 8/2003 Snyder ..... F24F 13/084 220/3.5
6,860,073 B2 3/2005 Chien
7,082,732 B2 * 8/2006 Titishov ..... E04B 2/8617 52/426
7,739,846 B2 6/2010 Garrett
7,743,565 B2 6/2010 Pyo
7,762,033 B2 7/2010 Scott et al.
7,805,906 B2 10/2010 Garrett
7,874,112 B2 1/2011 Kovatch et al.
8,037,652 B2 * 10/2011 Marshall ..... E02D 27/02 52/309.11
8,800,218 B2 8/2014 Robak
8,984,827 B2 * 3/2015 Schreer ..... E04B 2/8617 52/309.15
2002/0092253 A1 * 7/2002 Beliveau ..... B29C 44/1271 52/426
2003/0140574 A1 * 7/2003 Mothes ..... B28B 17/0018 52/98
2007/0113505 A1 * 5/2007 Beliveau ..... E04B 2/8617 52/426
2008/0028709 A1 * 2/2008 Pontarolo ..... E04B 2/8647 52/426
2009/0007509 A1 1/2009 Jordan et al.
2012/0096797 A1 * 4/2012 Garrett ..... E04B 2/8635 52/426
2013/0000222 A1 * 1/2013 Robak ..... E04B 2/86

* cited by examiner

INSULATING CONSTRUCTION PANELS, SYSTEMS AND METHODS

REFERENCE TO RELATED APPLICATION

The present application is based on and claims benefit of Provisional Application Ser. No. 62/391,636 filed May 5, 2016 and entitled "INSULATING CONSTRUCTION PANELS, SYSTEMS AND METHODS," the entire contents of which are herein incorporated by reference.

BACKGROUND

Technical Field

The present disclosure relates to construction panels and, in particular, to insulating constructions panels, systems and methods.

Description of the Background Art

Various construction techniques have been devised. Many of these techniques are directed at lowering the overall cost of construction by reducing the cost of materials, time required and/or the amount of labor required. In addition, with the recent push towards energy independence and becoming a "Green" society, various types of new or modified construction techniques have been directed at making structures (for example, homes) more energy efficient. Construction techniques have also been developed to make recycling of materials more practical and efficient.

One area of concern involves the construction of the foundation (or wall) of a structure. The function of a foundation is to support the weight of the structure and to provide a level surface to build on. The foundation will also often form the wall of a portion of the structure such as a basement wall. Foundations can be built from various types of materials including stone, brick, concrete block, treated lumber or poured concrete. Of these, poured concrete is one of the most widely used materials.

Poured concrete foundations have been built using various types of methods and can include poured slabs as well as raised perimeter foundations. One of the oldest and most basic methods of forming a poured concrete raised perimeter foundation is to use wooden forms. This method involves placing two parallel wooden structures spaced a predetermined distance from each other along the footprint or perimeter of the structure to be constructed. Concrete is a material that is very strong in compression but is relatively weak in tension. Accordingly a reinforcing bar, also known as rebar, is normally used in this type of construction and is cast into the concrete to carry the tensile loads. The rebar is arranged at predetermined positions within the parallel wooden structures and held in place with wood and/or metal ties. The concrete is then poured into the space between the wooden structures and allowed to set. After setting, the wooden structures are removed, leaving the poured concrete foundation upon which the structure can be built.

It will be appreciated that the process of setting up and breaking down the wooden structure and arranging the rebar is vary time consuming and labor intensive.

A variety of insulating concrete form systems, known as insulated concrete forms or blocks, have been developed for casting a concrete foundation or wall. Often, these systems include interlocking blocks that are formed from a pair of opposed foam panels connected together in a spaced, parallel relationship by a plurality of tie members to define a concrete receiving cavity. The blocks are aligned and stacked to define a wall, and concrete is poured into the concrete receiving cavities. The blocks are maintained in place after the concrete hardens to insulate the concrete, provide a sound barrier, insulation, and serve as a backing for finishing material.

While many insulating concrete form systems have met with some success, numerous problems exist with these systems. For example, problems are encountered while fitting the panels or blocks together, pouring the concrete into the forms, difficulty of utility installation and attachment of finishing materials to the insulated concrete wall. There are also issues with the transportation and storage of the preassembled types of blocks. Many of these systems require specially molded corner blocks. There are also issues involved with manufacturing these form systems. For example, these form systems often require costly manufacturing processes for providing connectors or tie members embedded in the inner faces of the insulating panels or blocks.

Accordingly, there is a need for an improved insulating concrete form that overcomes the problems experienced with the previously known forms.

SUMMARY

This application describes (in the form of methodologies, apparatuses, and systems) for insulating construction panels, systems and methods.

An insulated construction panel having a top end, a bottom end, a first end, a second end, a front side and a rear side, the panel for constructing a single or multi-thickness concrete form, the panel including regularly spaced coplanar passages extending completely through the panel from the top end of the panel toward and through to the bottom end of the panel. For each of the regularly spaced coplanar passages, an angular passage perpendicularly intersecting each coplanar passage at the top end and extending toward and through a portion of a front side surface of the front side and rear side surface of the rear side of the panel, each angular passage extending only partially through the panel from the top end toward the bottom end. For each of the regularly spaced coplanar passages, an angular passage perpendicularly intersecting each coplanar passage at the bottom end and extending toward and through a portion of the front side surface of the front side and the rear side surface of rear side of the panel, each angular passage extending only partially through the panel from the bottom end toward the top end.

A fire proof construction panel for constructing a single or multi-thickness concrete form, the panel including regularly spaced coplanar passages extending completely through the panel from a top end of the panel toward and through to a bottom end of the panel, for each of the regularly spaced coplanar passages, an angular passage perpendicularly intersecting each coplanar passage at the top end and extending toward and through a front side and a portion of a rear side surface of a rear side of the panel, each angular passage extending only partially through the panel from the top end toward the bottom end and for each of the regularly spaced coplanar passages, an angular passage perpendicularly intersecting each coplanar passage at the bottom end and extending toward and through the front side and a portion of the rear side surface of rear side of the panel, each angular passage extending only partially through the panel from the bottom end toward the top end.

A concrete form system includes a plurality of construction panels, an insertable tie for interconnecting the plurality of construction panels and a flat-shaped molding for interlocking one or more of the plurality of construction panels.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

The following exemplary embodiments are set forth to aid in an understanding of the subject matter of this disclosure, but are not intended, and may not be construed, to limit in any way the subject matter or claims which follow thereafter. Therefore, while specific terminology is employed for the sake of clarity in describing some exemplary embodiments, the present disclosure is not intended to be limited to the specific terminology so selected, and it is to be understood that each specific element includes all technical equivalents which operate in a similar manner.

Figure 17:
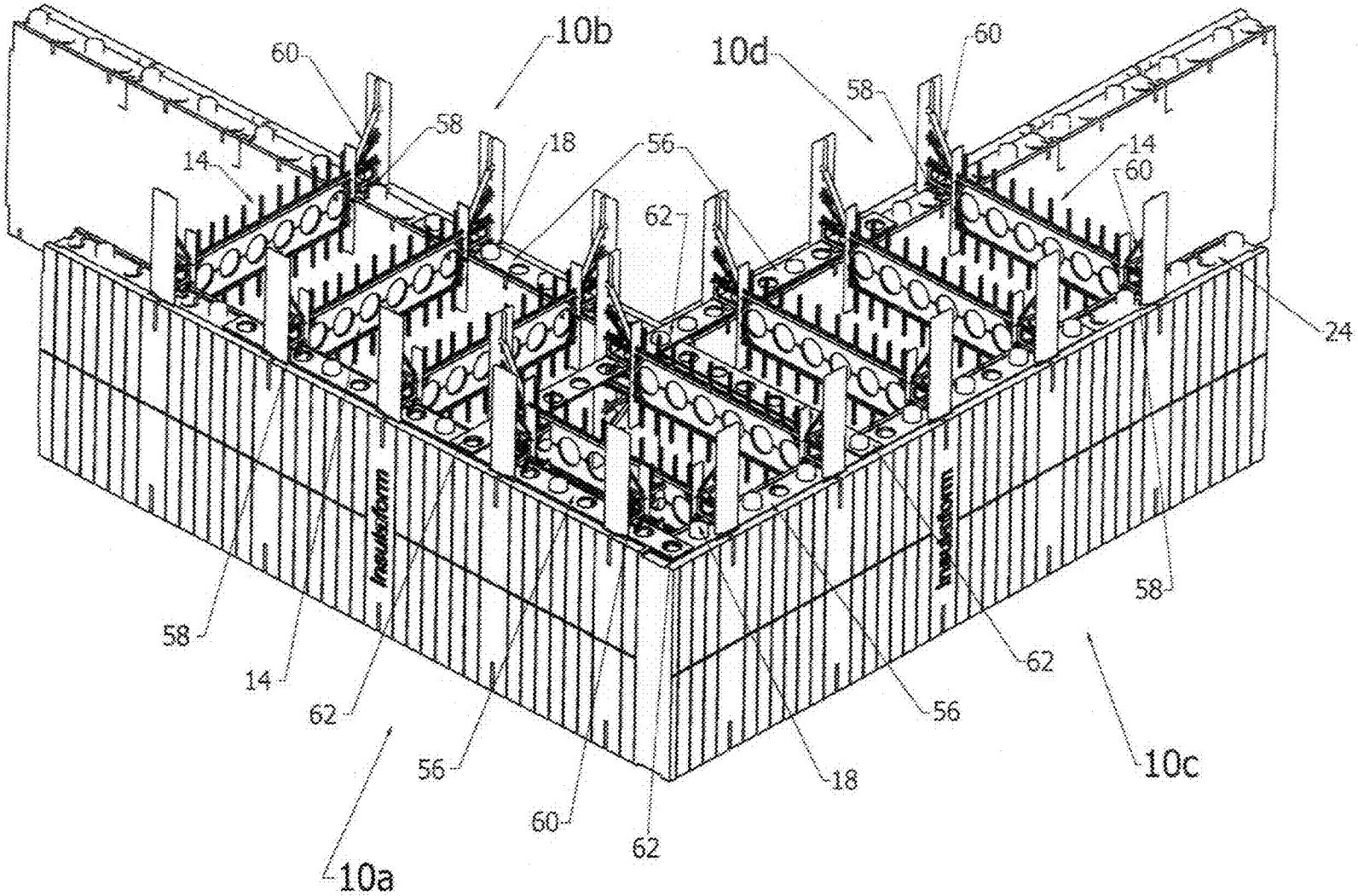
FIG. 17 is a perspective view of an assembled corner form according to an illustrative embodiment of the present disclosure, showing construction panels, ties and flat-shaped moldings.

An insulating panel construction system according to an illustrative embodiment of the present disclosure is shown in FIG. 17. The system has several components including, for example, interlocking panels 10 (e.g., 10*a*-10*d*) forming sides of the concrete form. Insertable ties 14 are provided for maintaining the panels a predetermined distance apart forming a space between panels for concrete to be poured. Flat-shaped moldings 56 are provided for tying a plurality of the interlocking panels together at corners of the concrete form.

When the insulating panel construction system according to illustrative embodiments of the present disclosure is erected, concrete is poured into the cavities between the panels. After the concrete sets, the panel construction system is maintained in place. The panels insulate the concrete, provide a sound barrier, insulation, and serve as a backing for finishing material.

The individual components forming the insulating panel construction system according to illustrative embodiments of the present disclosure will be described, followed by a further description of how the individual components fit together to provide a superior construction system.

Figure 1:
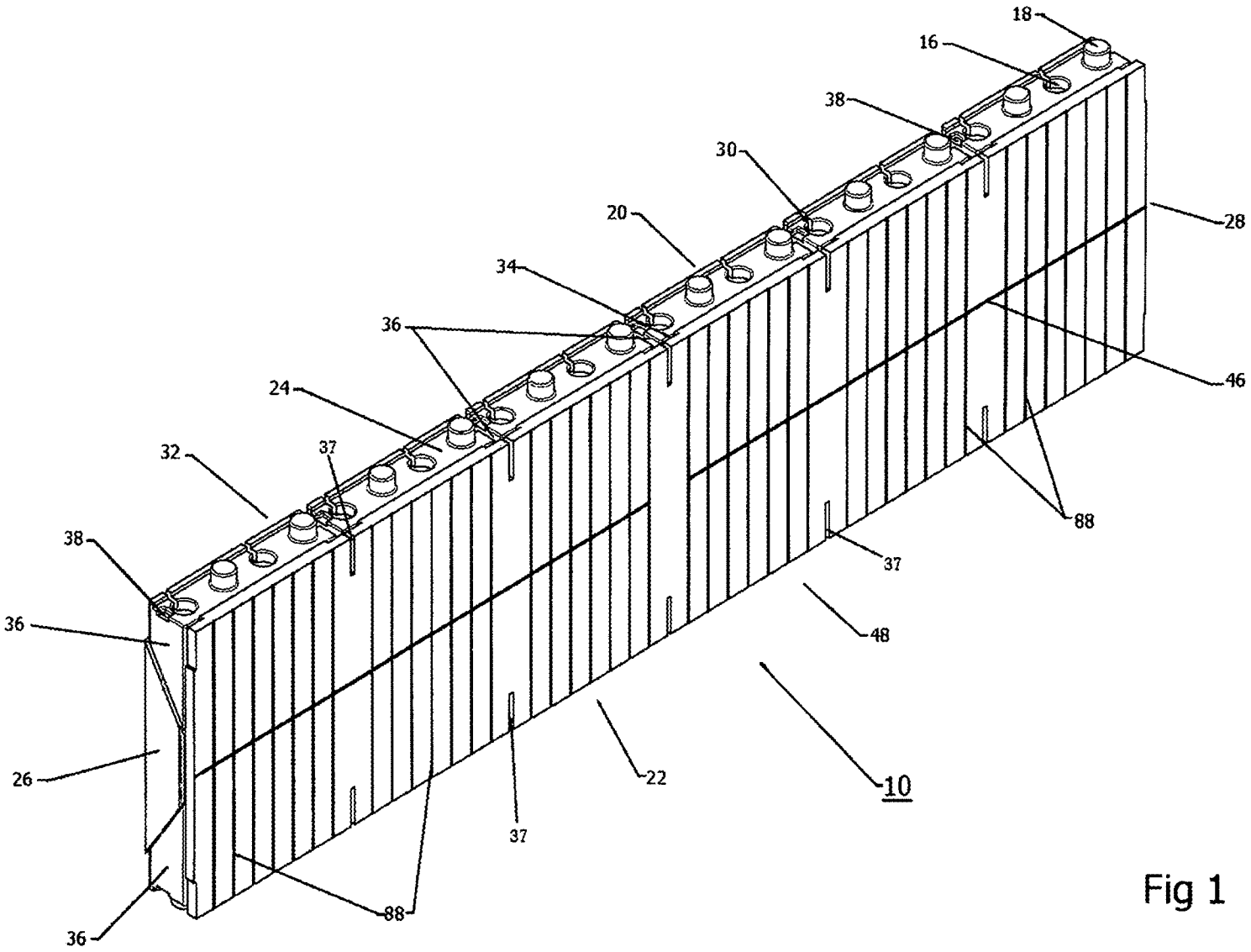
FIG. 1 is a perspective view of the front side of an insulating construction panel according to an illustrative embodiment of the present disclosure.
Figure 2:
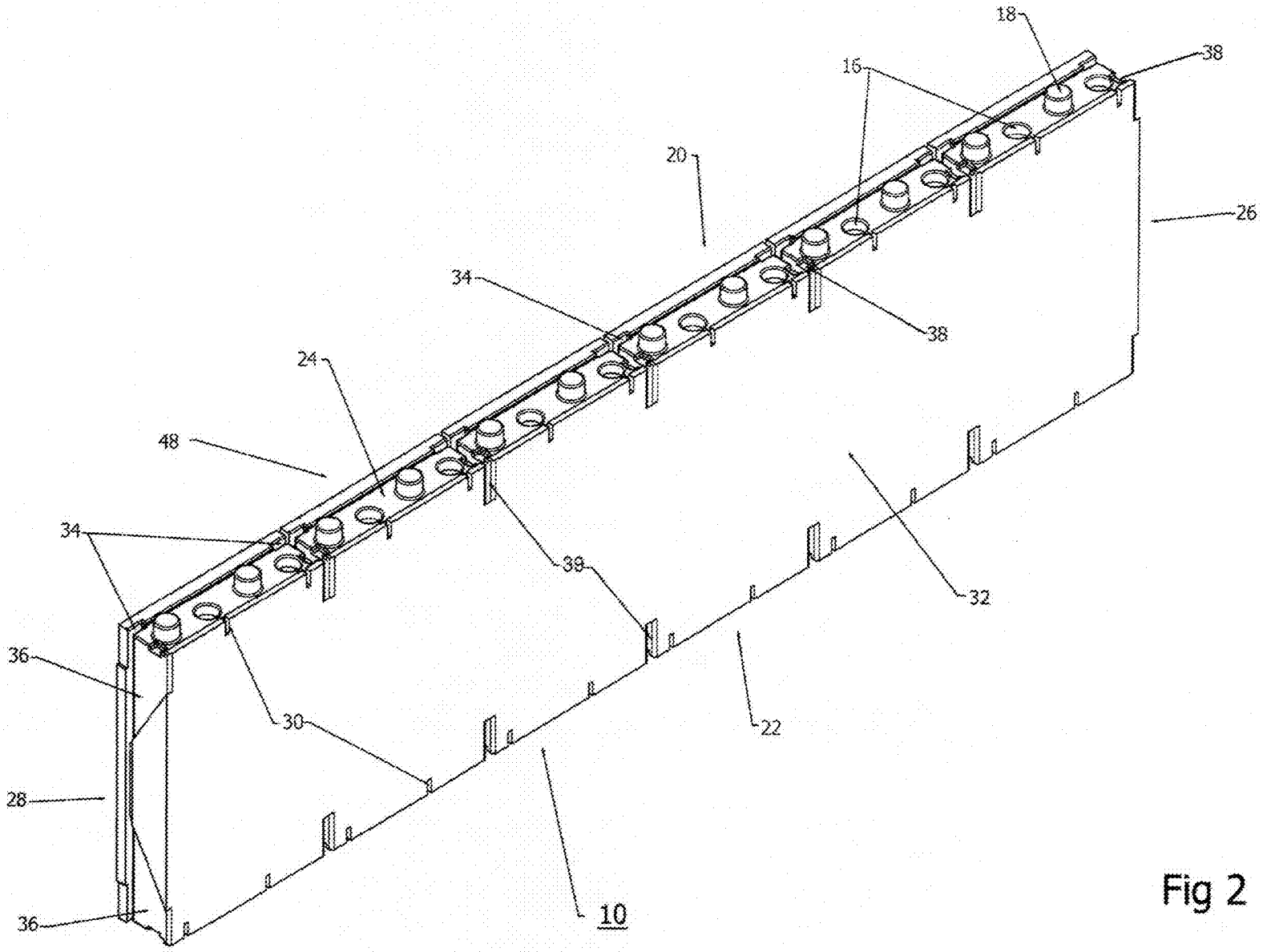
FIG. 2 is a perspective view of a rear side of the insulating construction panel according to an illustrative embodiment of the present disclosure.

FIGS. 1 and 2 illustrate perspective views of a front side 48 and a rear side 32, respectively, of an insulating construction panel 10 according to an embodiment of the present disclosure. Insulating construction panel 10 includes an end 26 and an end 28, top end 20 and bottom end 22, a front side 48 and a rear side 32. Front side 48 has a generally horizontal ridge or marking 46 indicating a best location for horizontal grooving and utility installation as will be described later below. Regularly spaced vertical grooves or markings 88 are provided to aid in measurements for cutting and indicate locations of elongated plates that extend into passages 34 in the panel 10. This allows screws or other attachments to be inserted through the front side 48 of panel 10 and into the elongated plates for finishes attachment. Top end 20 and bottom end 22 include a flat shaped depression or recess 24 extending from end 26 to end 28. The height of panel 10 from top end 20 to bottom end 22 may be any suitable dimension. For example, depending on a particular application, the height may be approximately 12". The thickness of panel 10 may also be any suitable dimension. For example, depending on a particular application, the thickness of panel 10 may be approximately 2.5". A plurality of similarly dimensioned, alternating projections 18 and recesses 16 are also equally spaced between end 26 and end 28. Drainage grooves 30 extend from recesses 16 to the rear side 32 of panel 10. Regularly spaced coplanar passages 34 extend through the insulating construction panel 10 from the top end 20 to the bottom end 22. For each of coplanar passage 34 there are two perpendicularly intersecting angular passages 36 extending from the top end 20 and bottom end 22 through rear side 32 and front side 48. As shown in FIG. 1, passages 36 extend through a front side surface of the front side 48 and form slots 37 at the top end 20 and bottom end 22. As shown in FIG. 2, passages 36 also extend through a rear side surface of the rear side 32 and form slots 39 at the top end 20 and bottom end 22. Small recesses 38 are located within the flat shaped depression or recess 24 on both sides of angular passages 36.

Figure 3:
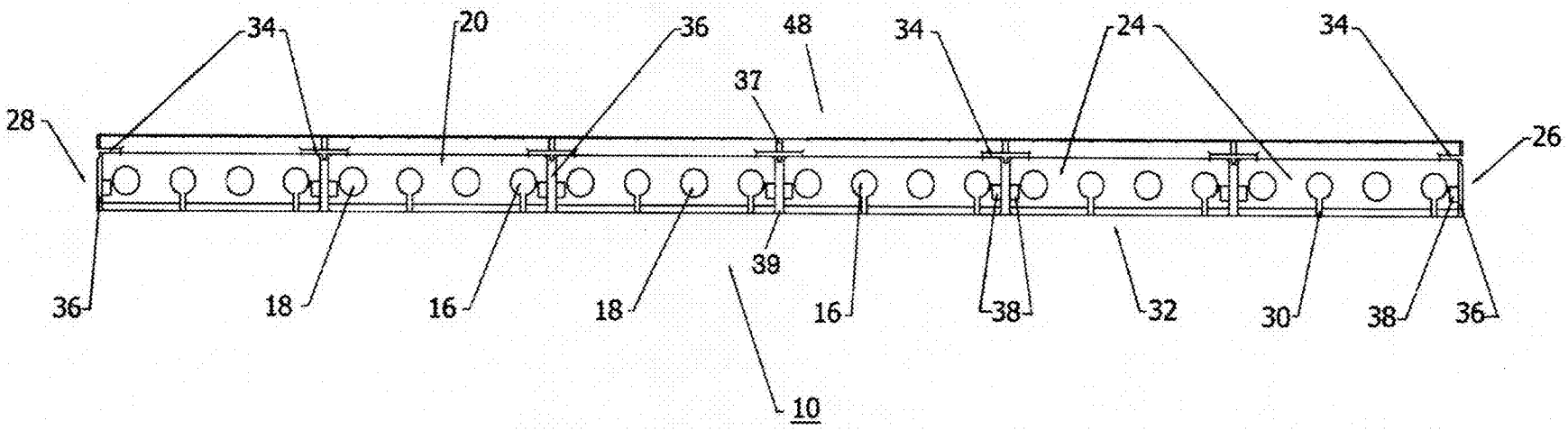
FIG. 3 is a top end or bottom end plan view of a construction panel according to an illustrative embodiment of the present disclosure.
Figure 4:
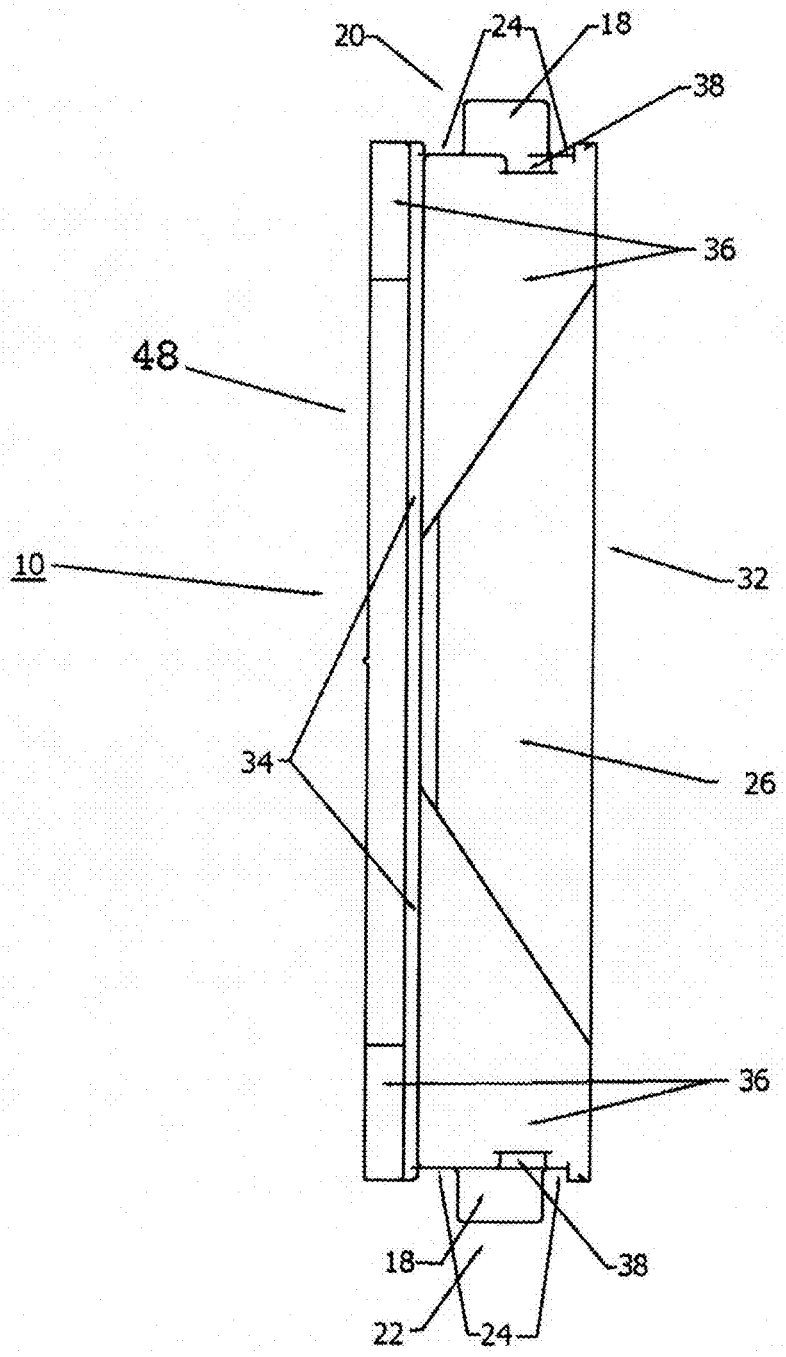
FIG. 4 an end view of a construction panel according to an illustrative embodiment of the present disclosure.

As shown in more detail in FIGS. 3 and 4, top end 20 and bottom end 22 include flat shaped depressions or recesses 24. The flat-shaped recesses 24 extend from first end 26 of panel 10 to the second end 28 of panel 10. The top end 20 includes a plurality of similarly dimensioned, alternating projections 18 and recesses 16 equally spaced between first end 26 and second end 28. As shown in FIG. 3, drainage grooves 30 extend from recesses 16 through the rear side 32 of the panel 10. Regularly spaced coplanar passages 34 extend through the panel 10 from the top end 20 to the bottom end 22. For each coplanar passage 34 there are two perpendicularly intersecting angular passages 36 extending from the top end 20 and bottom end 22 and through to rear side 32 and front side 48. Recesses 38 are located within the flat shaped recess 24 on both sides of angular passages 36.

Figure 5:
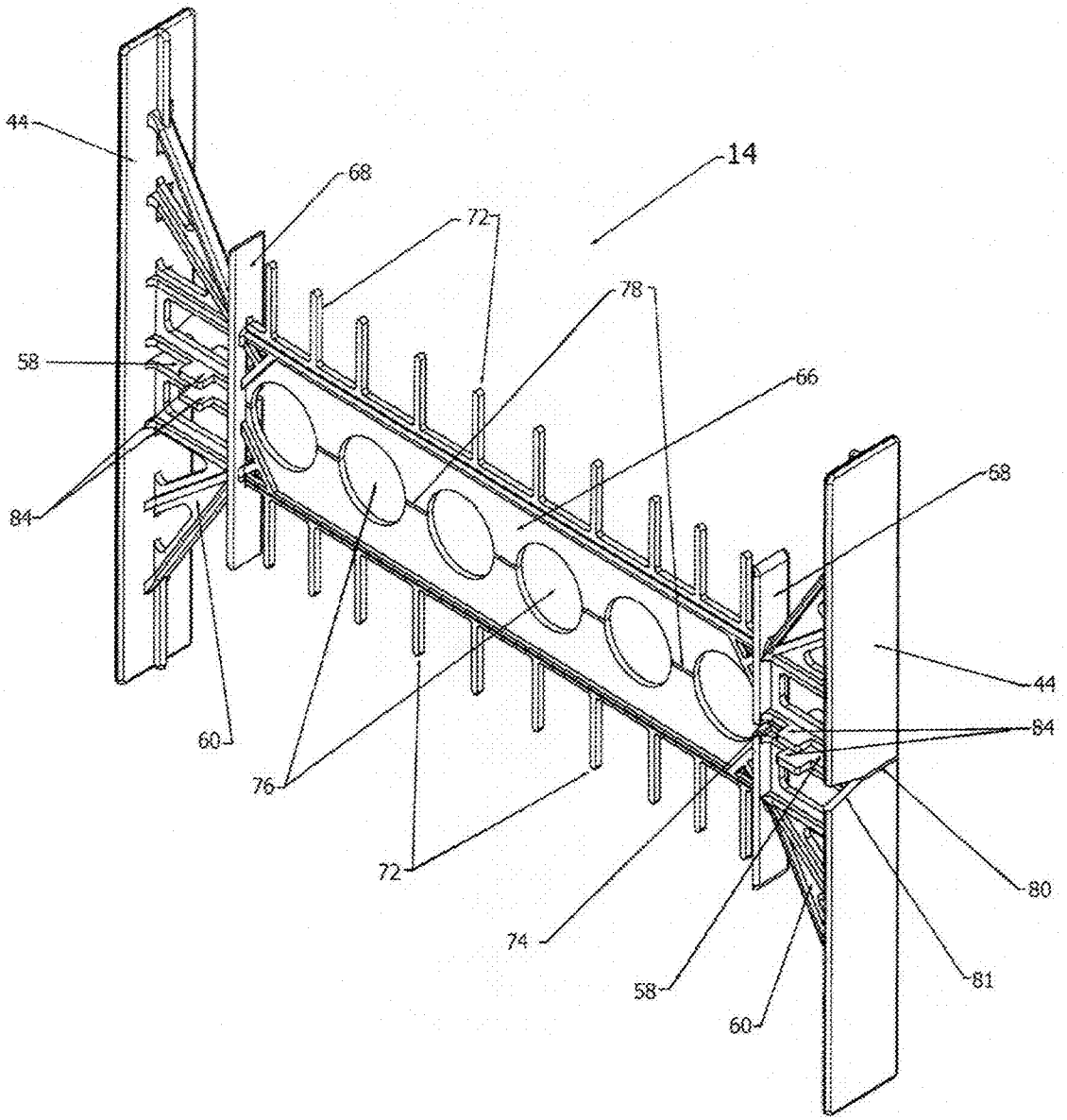
FIG. 5 is a perspective view of a tie according to an illustrative embodiment of the present disclosure.
Figure 6:
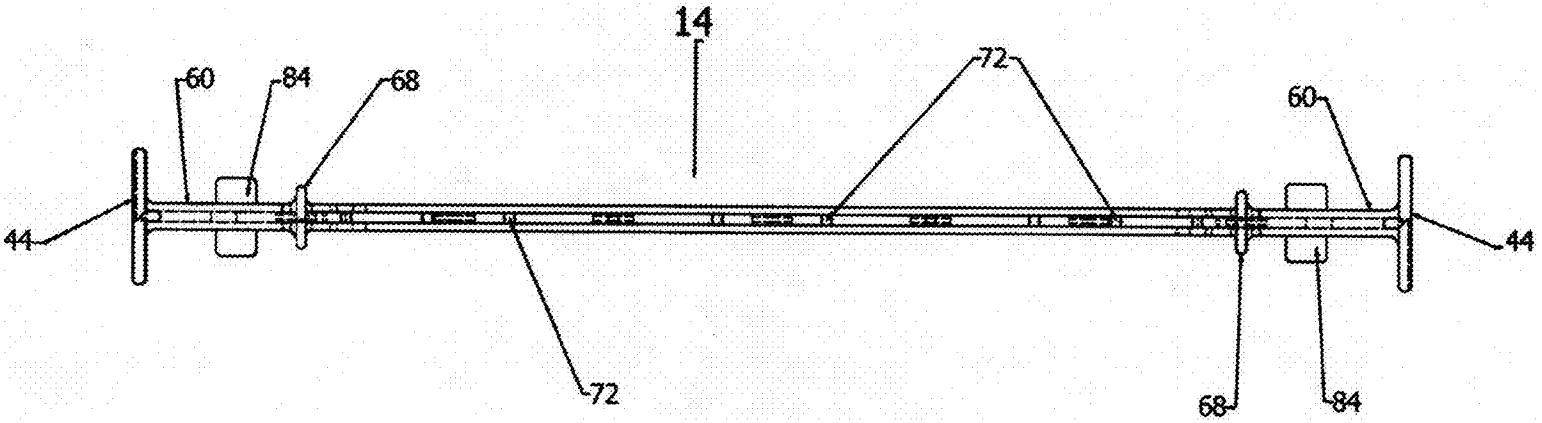
FIG. 6 is a bottom end plan view of a tie according to an illustrative embodiment of the present disclosure.
Figure 7:
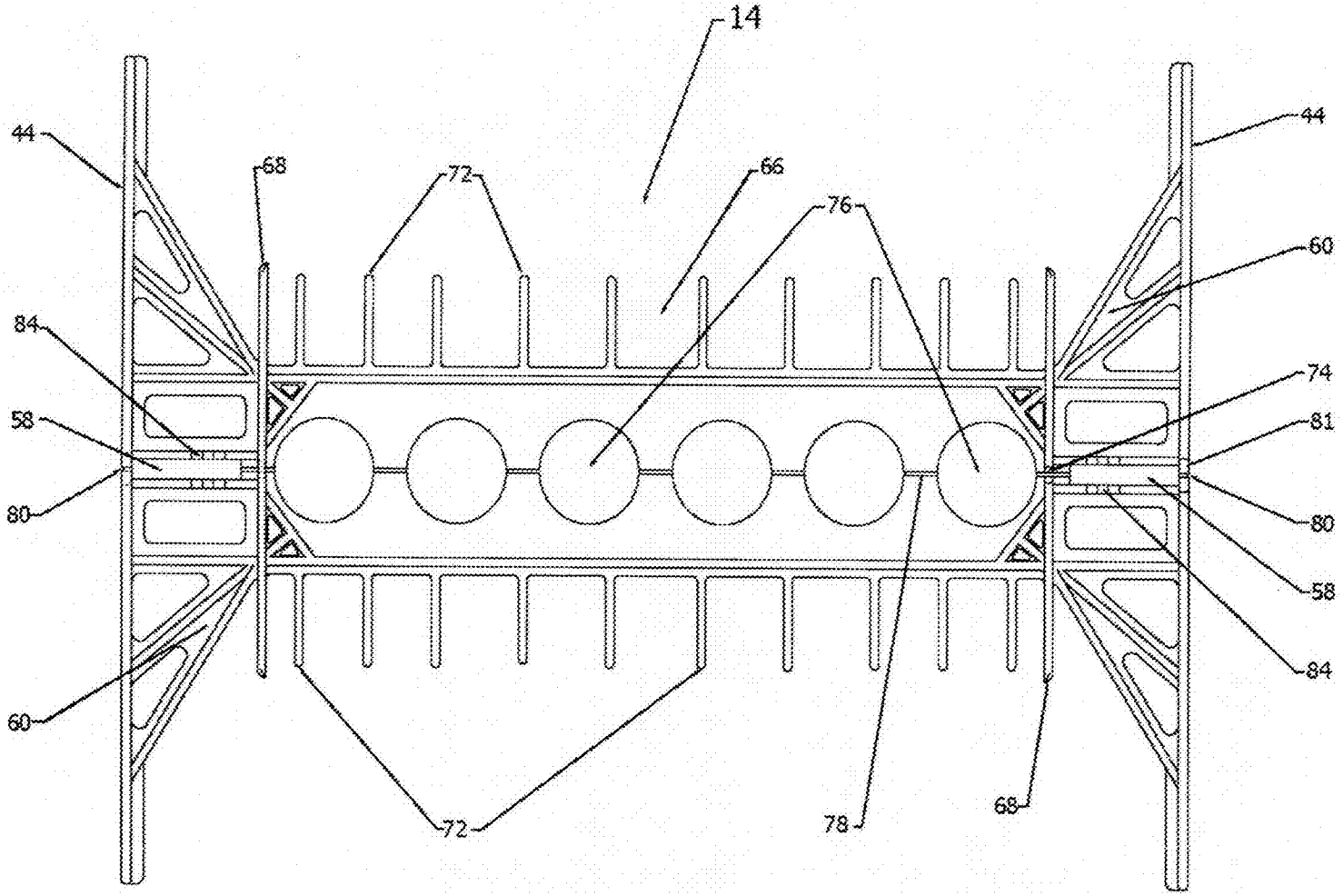
FIG. 7 is a side view of a tie according to an illustrative embodiment of the present disclosure.

FIGS. 5-7 illustrate views of a tie 14, according to illustrative embodiments of the present disclosure. Tie 14 includes spacer 66, perpendicular stoppers 68 with V-shaped notches 74, angular connectors 60, and perpendicular elongated plates 44 with horizontal marking 80 along the center and including a V-shaped notch 81. According to an illustrative embodiment of the present disclosure, notch 74 is relatively smaller than notch 81. Regularly spaced pins 72 are located on at least one of the top and bottom of spacer 66. Pins 72 are provided allowing rebar or other structural members to be added to the foundation as desired and to keep additional layers of insulating construction panels in a desired position. Regularly spaced orifices 76 and continuous horizontal marking and/or horizontal notch 78 along the center of spacer 66 may also be provided. Angular connectors 60 include centrally located flat-shaped passages 58 and tabs 84 extending perpendicularly from angular connector 60 on both sides above and below flat-shaped passages 58. The V-shaped notches 74, 81 and horizontal marking and/or notch 78 allow the tie 14 to be split into two halves without the use of any cutting tools. For example, ties 14 may be snapped in half along notches 74, 78 and 81. The length of tie 14 may be provided in any suitable dimension. For example, depending on a particular application, the length of center spacer 66 spanning stoppers 68 may be 6", 8", 10", 12", 14", etc. Elongated plates 44 may be, for example, approximately just under 12" high, also depending on a particular application.

Figure 8:
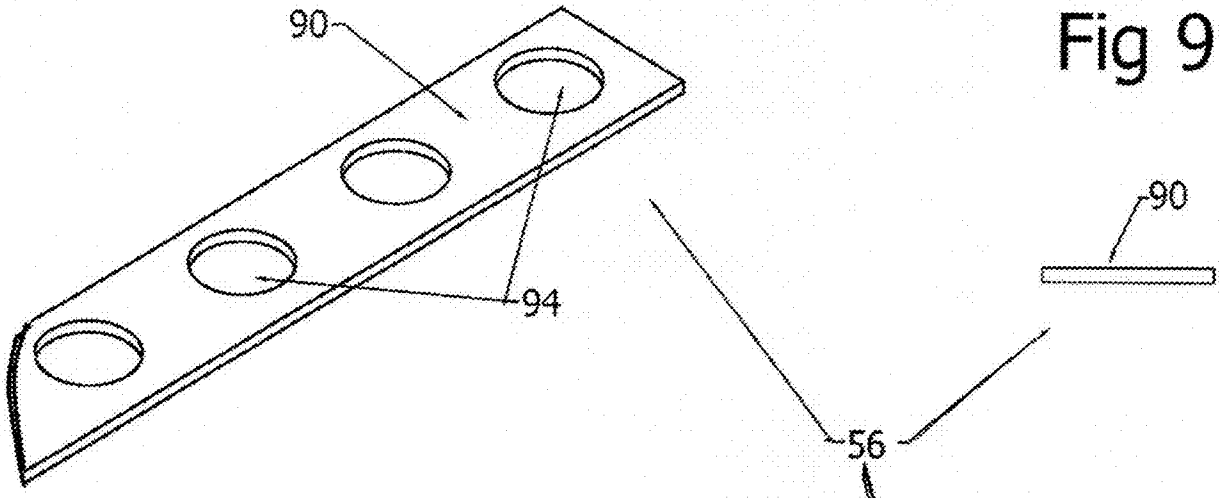
FIG. 8 is a fragmental perspective view of flat-shaped molding according to an illustrative embodiment of the present disclosure.
Figure 9:
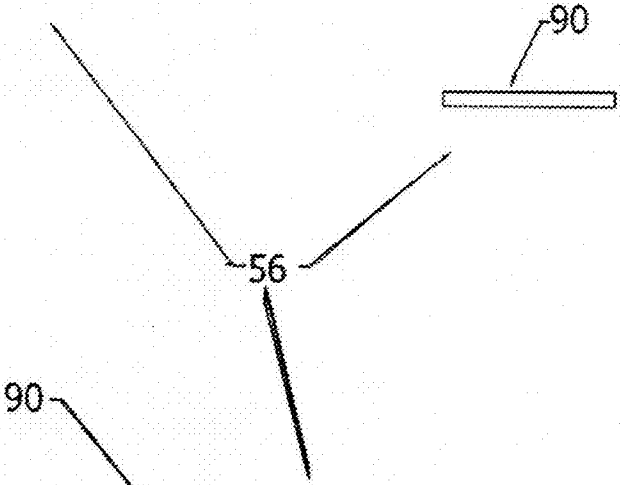
FIG. 9 is an end view of a flat-shaped molding according to an illustrative embodiment of the present disclosure.
Figure 10:
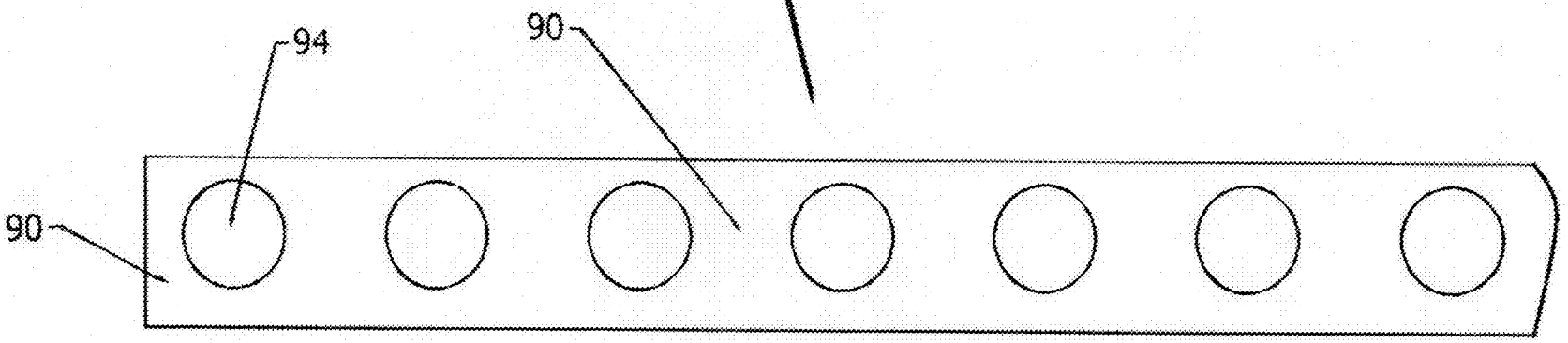
FIG. 10 is a fragmental plan view of a flat-shaped molding according to an illustrative embodiment of the present disclosure.

FIGS. 8-10 illustrate views of a flat-shaped molding 56 according to an illustrative embodiment of the present disclosure. Flat-shaped molding 56 includes web 90. Web 90 includes regularly spaced orifices 94. Regularly spaced orifices 94 are dimensioned to receive regularly spaced projections 18 on panels 10. Flat-shaped molding 56 and ties 14 can be made of any suitable type of material such as, for example, plastics, metals, alloys, etc. or combinations of such materials.

Figure 11:
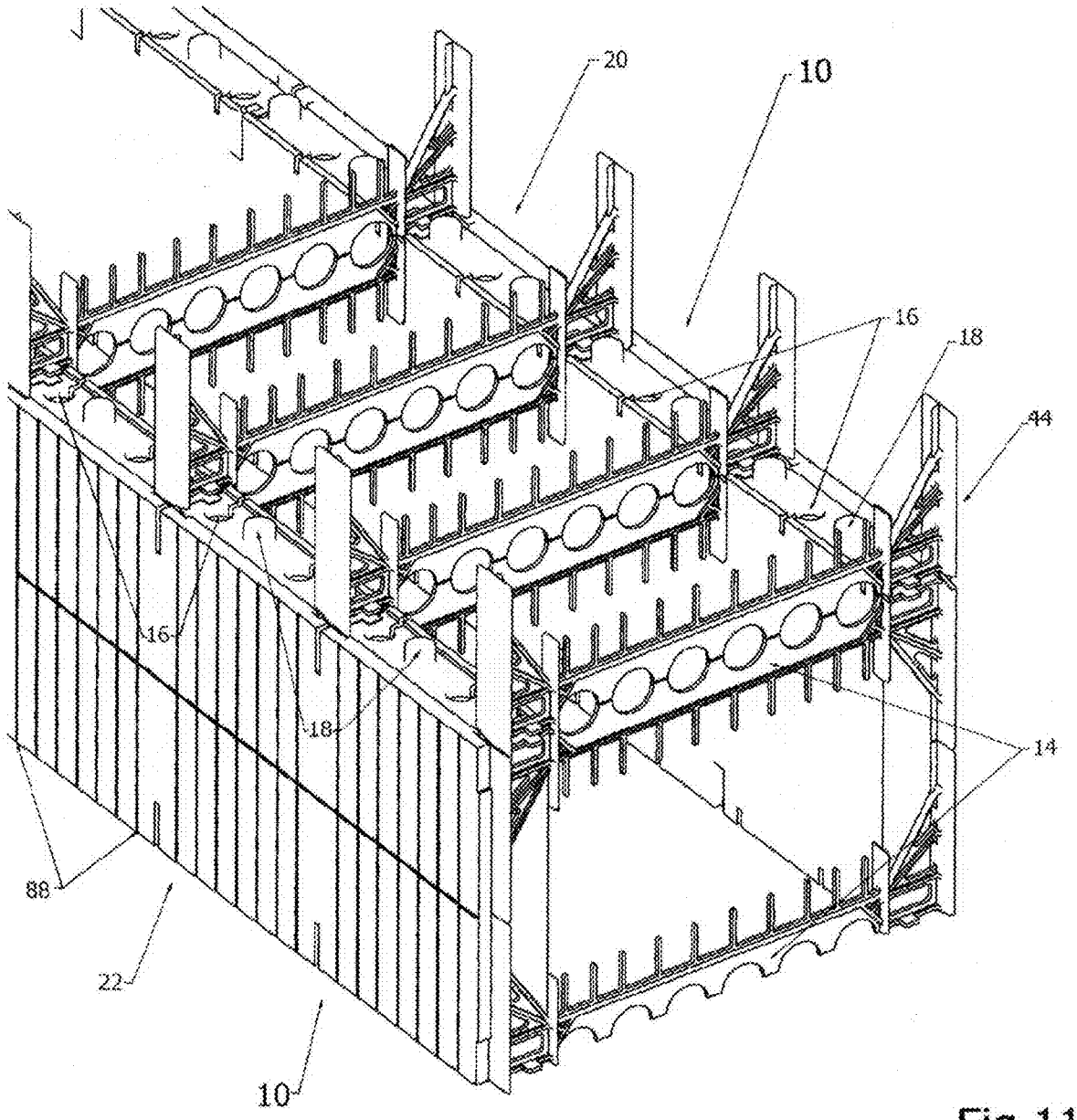
FIG. 11 is a fragmental perspective view of an insulating concrete form constructed utilizing illustrative embodiments of the present disclosure.

FIG. 11 illustrates portions of two identical insulating construction panels 10 interlocked with a plurality of insertable ties 14 at the top end 20 of panels 10 and a plurality of half-ties of the insertable ties 14 at the bottom end 22 of panels 10 according to an illustrative embodiment of the present disclosure. The ties 14 hold panels 10 in a fixed spaced parallel relationship, thereby defining the cavity dimension of the concrete form. Panels 10 are adapted to be stacked and interlocked with other insulating construction panels by the plurality of ties 14, recesses 16 and projections 18 in a bi-directional and/or reversible manner. Vertical grooves or markings 88 provide references for indicating location of the elongated plates 44 and aid in measuring and evenly cutting the panels 10. Plates 44 make secure attachment points for nails, screws, etc. used for mounting finishing materials to the face of panels 10.

Figure 12:
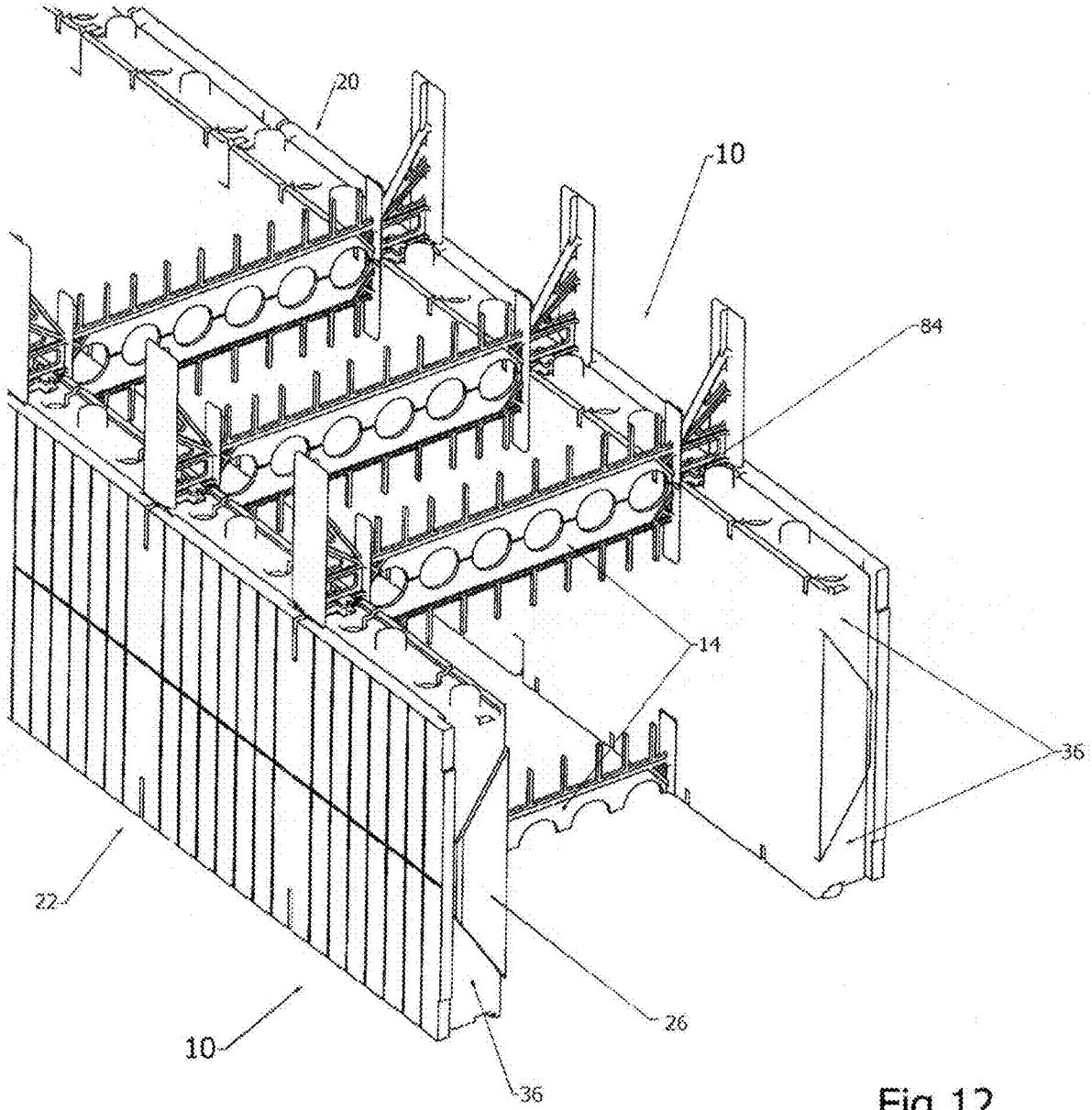
FIG. 12 is a fragmental perspective view of an insulating concrete form according to an illustrative embodiment of the present disclosure showing the ends of panels without an insertable tie.

FIG. 12 illustrates portions of two identical insulating construction panels 10 interlocked with a plurality of insertable ties 14 at the top end 20 of panels 10 and a plurality of half-ties of the insertable ties 14 at the bottom end 22 of panels 10 according to an illustrative embodiment of the present disclosure. The ties 14 have been removed from an end 26 of construction panels 10 for ease of viewing. Screws, nails, etc. can be driven through tabs 84 and into flat-shaped molding 56 (not shown) to hold ties 14 in place against panels 10 if necessary.

Figure 13A:
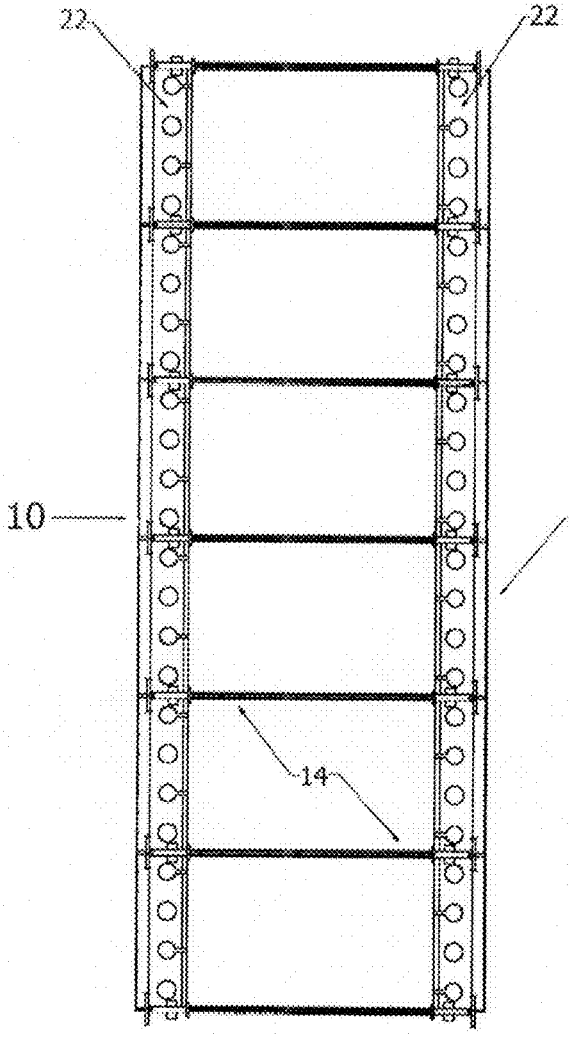
FIGS. 13A and 13B are top end and bottom end plan views, respectively, of the insulating concrete form of FIG. 11 according to an illustrative embodiment of the present disclosure.
Figure 13B:
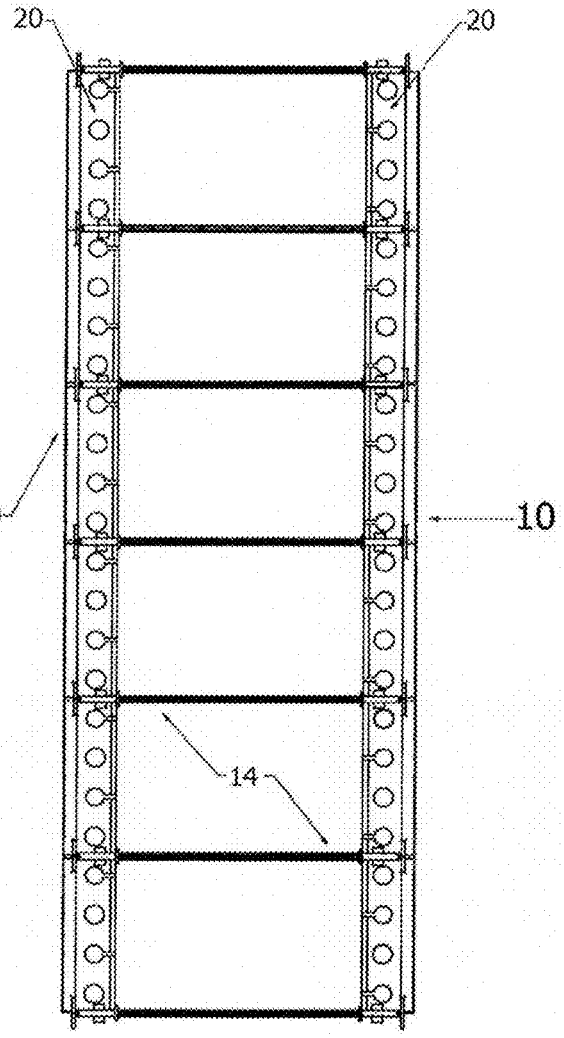

FIGS. 13A and 13B illustrate two identical insulating construction panels 10 interlocked with a plurality of insertable ties 14 at the bottom end 22 (FIG. 13A) and top end 20 (FIG. 13B) of panels 10 according to an illustrative embodiment of the present disclosure.

Figure 14:
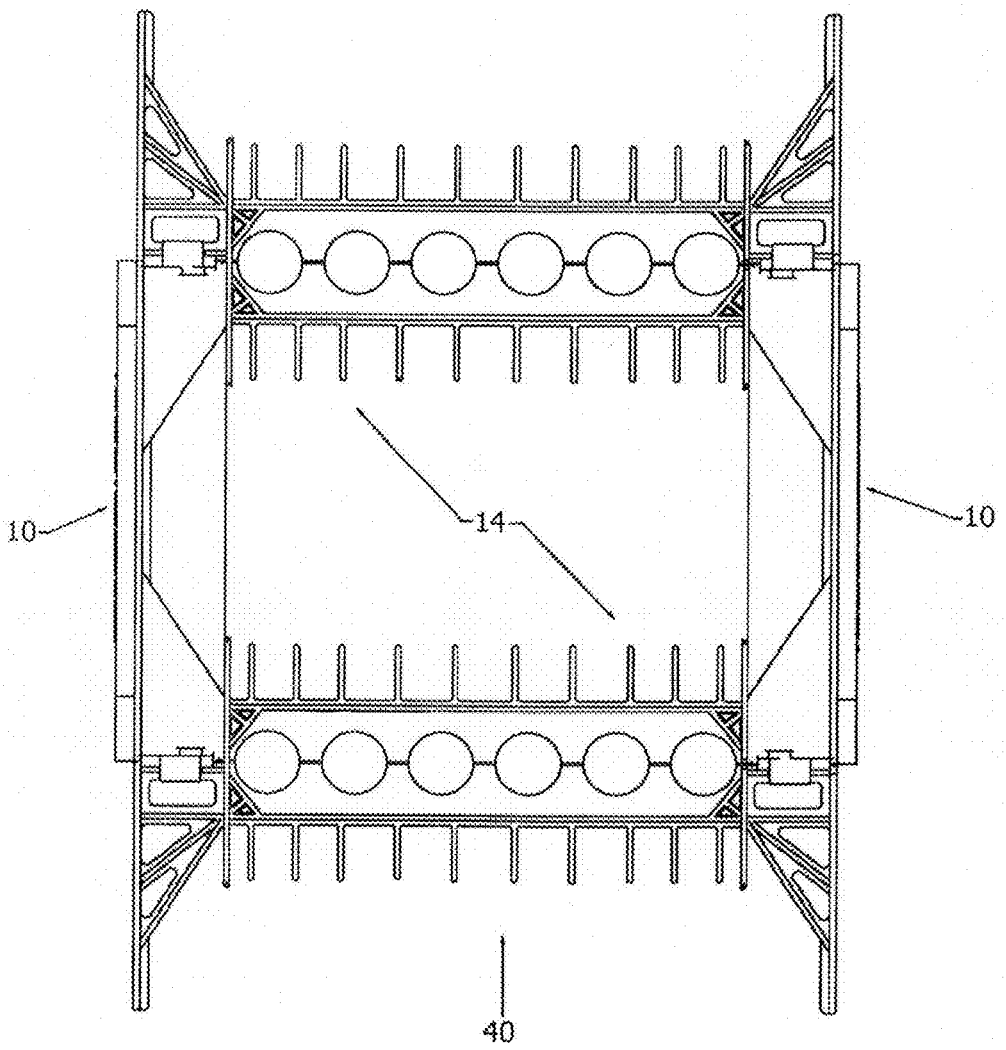
FIG. 14 is an end view of an assembled insulating concrete form according to an illustrative embodiment of the present disclosure with tie removed from the end of form.
Figure 15:
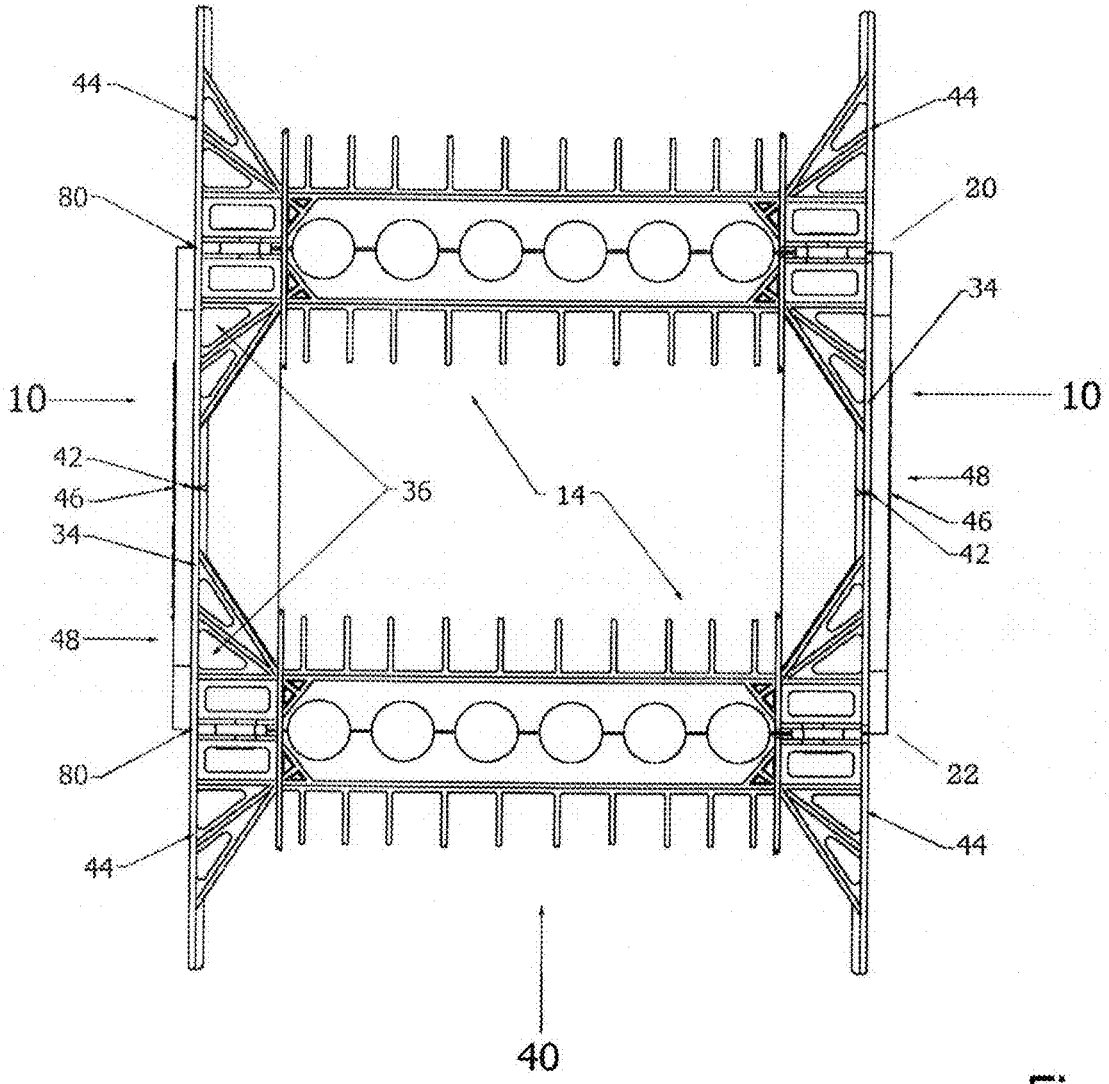
FIG. 15 is an end view of an assembled insulating concrete form according to an illustrative embodiment of the present disclosure showing full ties.

FIGS. 14 and 15 illustrate end views of the assembled single thickness concrete form 40 according to an illustrative embodiment of the present disclosure. The form 40 includes opposing construction panels 10 interlocked with a plurality of insertable ties 14. Ties 14 are inserted into coplanar passages 34 and angular passages 36 at the top end 20 and bottom end 22 of construction panels 10. There are small gaps 42 (see FIG. 15) between elongated plates 44 for easy cutting and utility installation in construction panels 10. Continuous horizontal marking 46 at front side 48 of construction panel 10 indicate a best location for horizontal grooving and installation of utilities.

Figure 16:
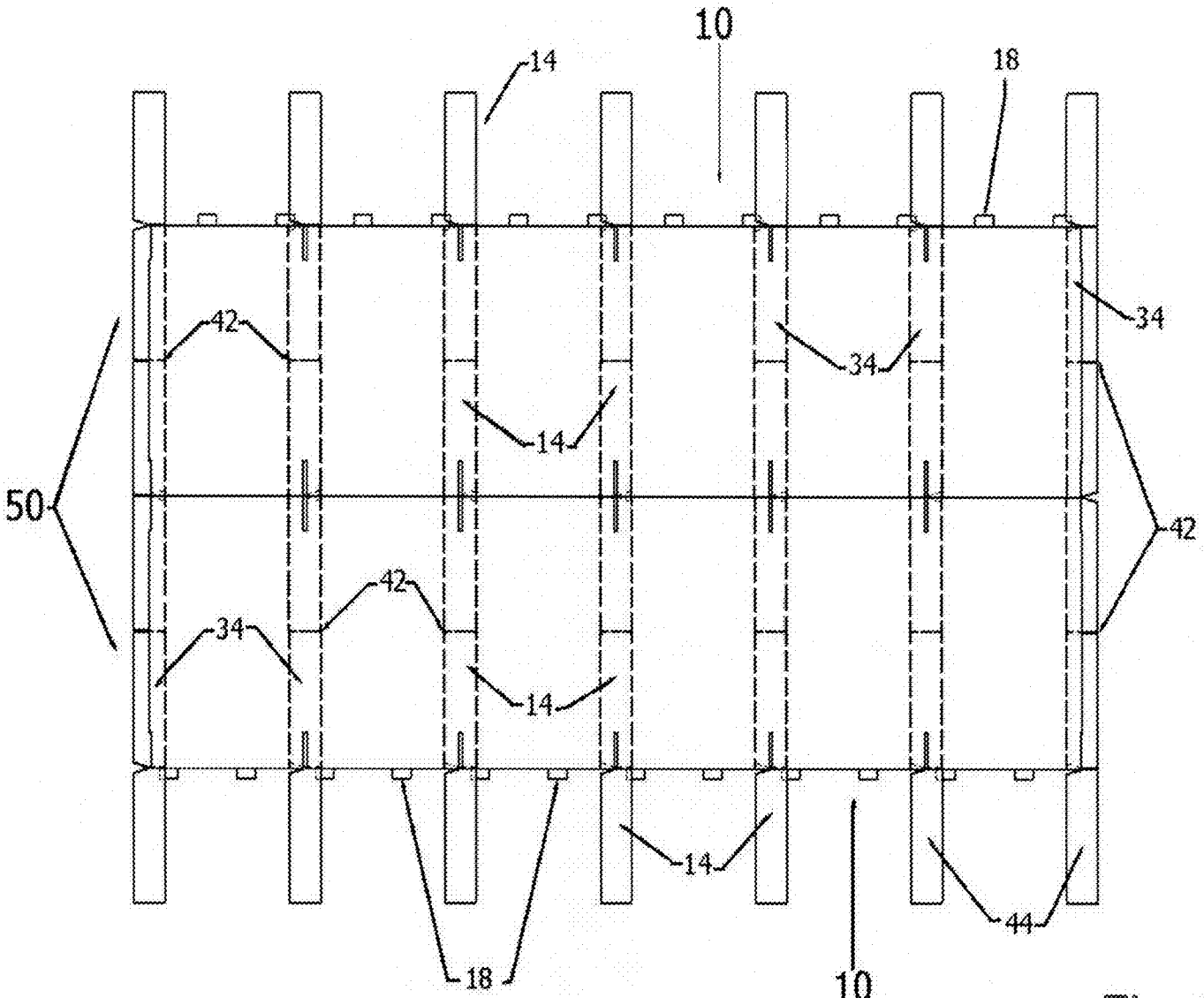
FIG. 16 is an elevation view of an assembled insulating concrete form according to an illustrative embodiment of the present disclosure, showing locations of insertable ties located within the front end of the construction panels.

FIG. 16 illustrates a side view of a portion of an assembled wall elevation 50 according to an illustrative embodiment of the present disclosure formed of a plurality of overlapping rows of vertically and horizontally aligned construction panels 10 connected with a plurality of ties 14 inserted into coplanar passages 34 and angular passages 36 at the top end 20 and bottom end 22 of construction panels 10. The interlocking of rows of construction panels results in perfect alignment of ties 14 and elongated plates 44 throughout the entire wall. Perfect alignment of elongated plates 44 greatly improves installation of wall finishes. Small gaps 42 between elongated plates 44 located in the center of each construction panel 10 greatly improve ease of cutting grooves and installation of utilities. Central location of gap 42 within each construction panel 10 prevents fresh concrete from entering into the preferred location for grooving and installing utilities within the construction panels 10 thus preventing damage to tools used to form the grooving.

FIG. 17 illustrates a perspective view of a single thickness corner form assembled with four identical construction panels 10 (10*a*, 10*b*, 10*c* and 10*d*) interlocked with a plurality of ties 14 and four flat-shaped moldings 56. Flat-shaped molding 56 is shaped and dimensioned to be inserted through the flat-shaped passage 58 located in the center part of angular connectors 60 (e.g., see FIG. 7) and placed over the protrusions 18 of construction panels 10 into the flat-shaped recesses 24. Flat-shaped moldings 56 overlap each other and interlock together at four points 62. The ties 14 that crisscross in the corner as shown in FIG. 17 are standard ties described above. According to an illustrative embodiment of the present disclosure, the ties 14 may be altered in the field by cutting through spacer 66 thru to orifices 76 or by simply snapping the ties 14 in half as described above (e.g., see FIG. 7). Ties 14 are cut on one side of corner assembly to allow ties 14 on the other side of the corner assembly to pass there through.

Figure 18:
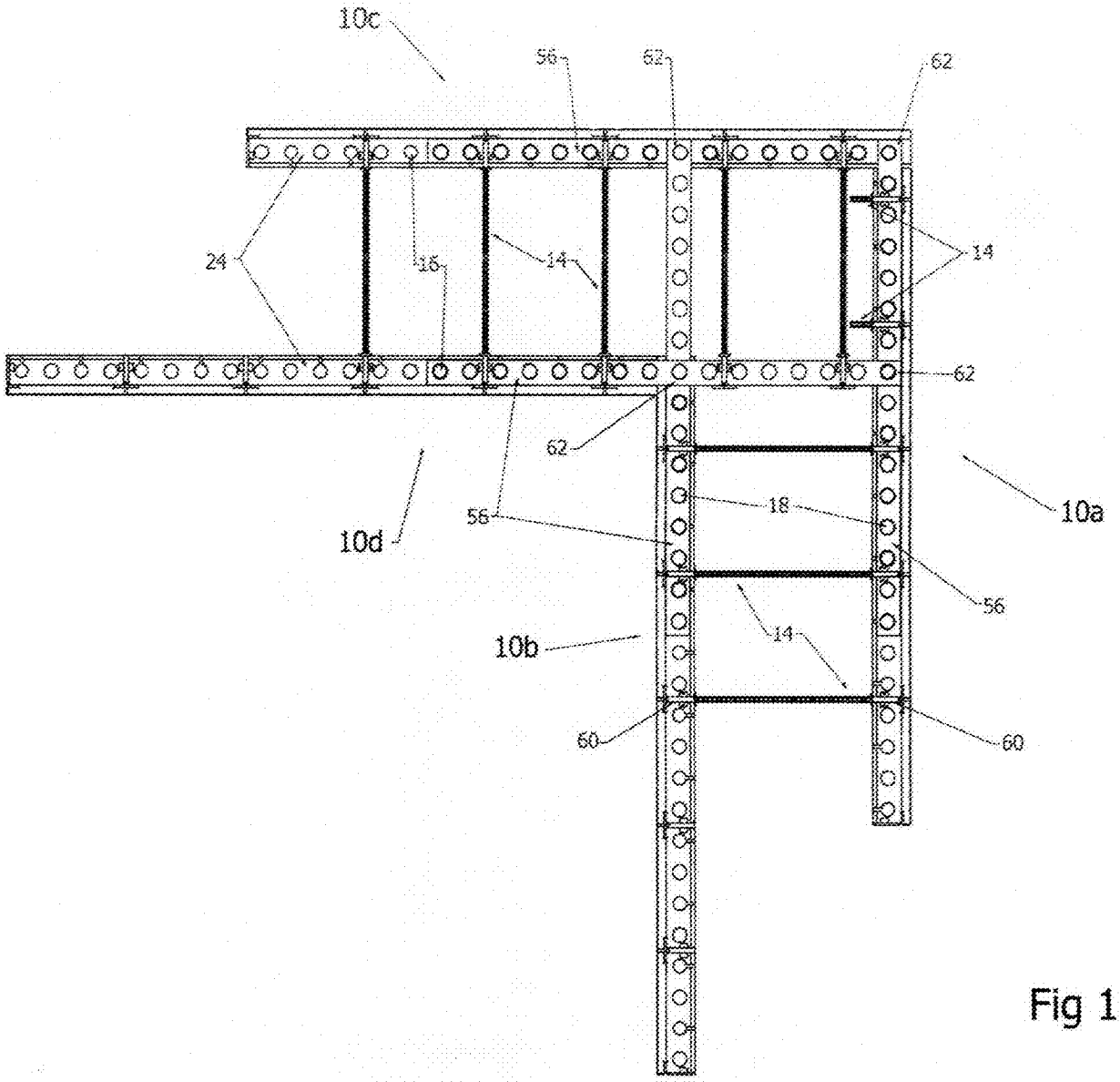
FIG. 18 is a plan view of an assembled corner form according to an illustrative embodiment of the present disclosure showing construction panels, ties and flat-shaped moldings.

FIG. 18 illustrates a plan view of a corner of the single thickness form assembled with four identical construction panels 10 (10*a*-10*d*) interlocked with the plurality of ties 14 and four flat-shaped moldings 56 according to an illustrative embodiment of the present disclosure. Flat-shaped molding 56 is inserted through the flat-shaped passage 58 located in the center part of angular connectors 60 and placed over the protrusions 18 of construction panels 10 and into the flat-shaped recesses 24.

Figure 19:
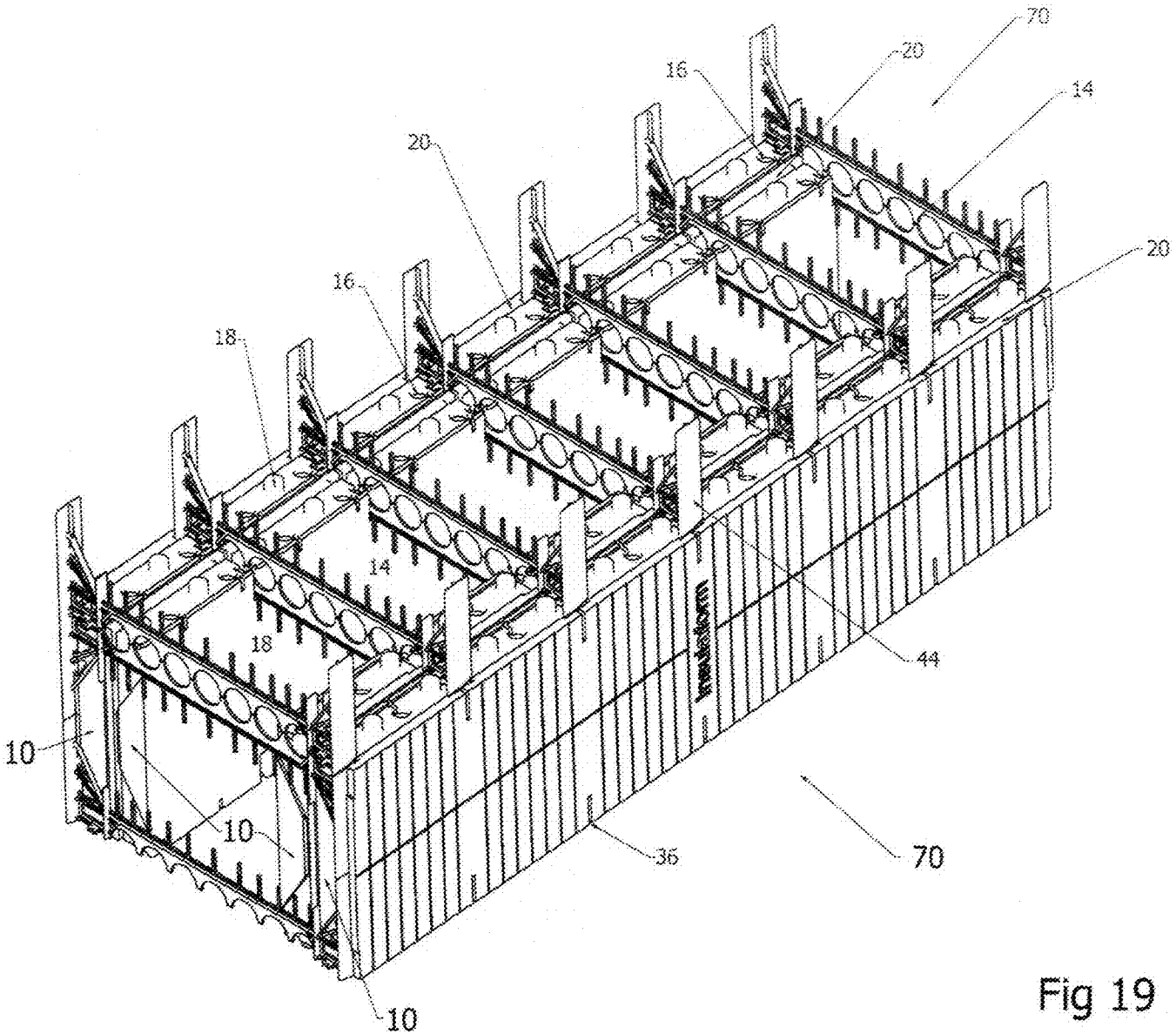
FIG. 19 is a perspective view of a multi-thickness insulating concrete form according to an illustrative embodiment of the present disclosure.
Figure 20:
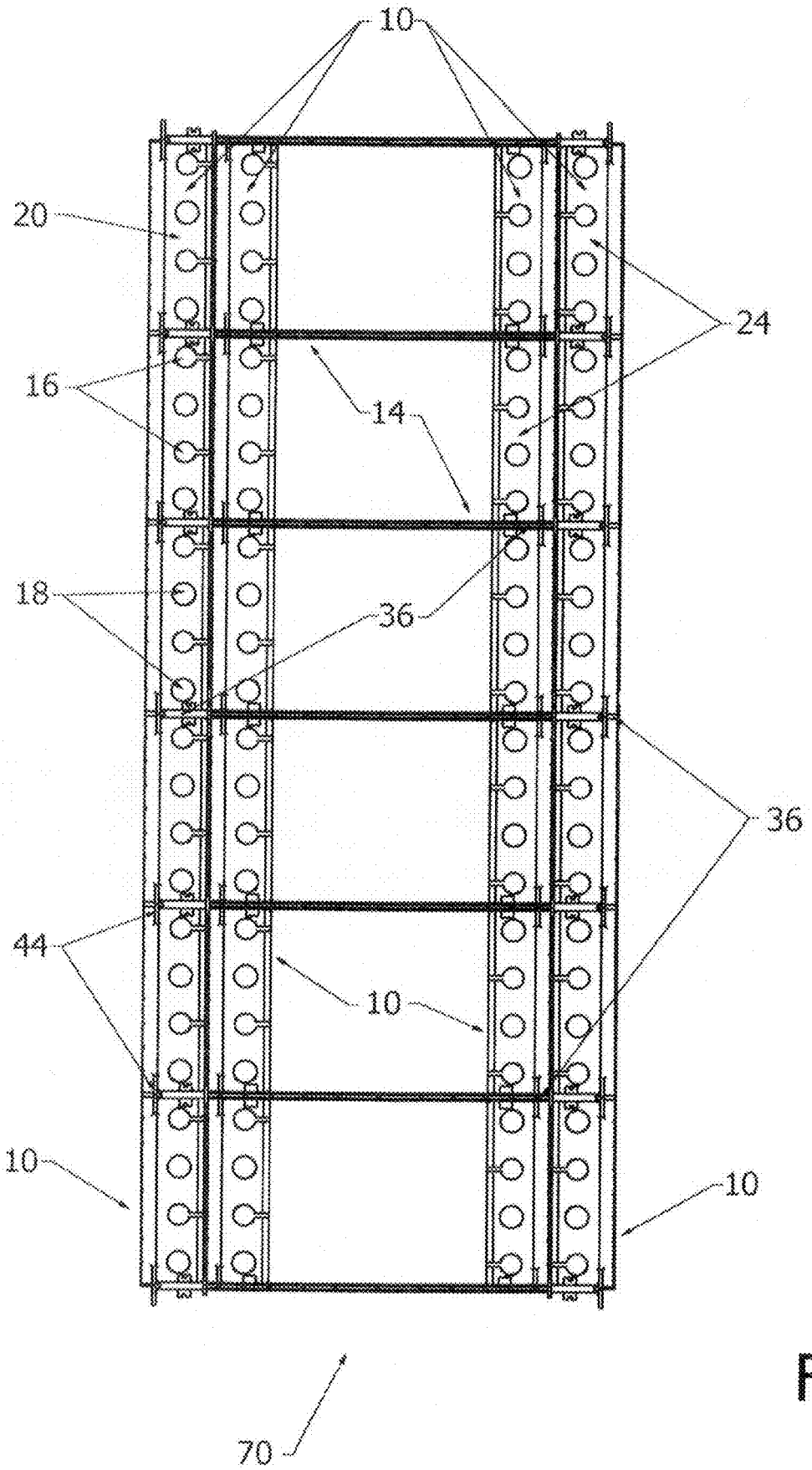
FIG. 20 is a plan view of a multi-thickness insulating concrete form according to an illustrative embodiment of the present disclosure.
Figure 21:
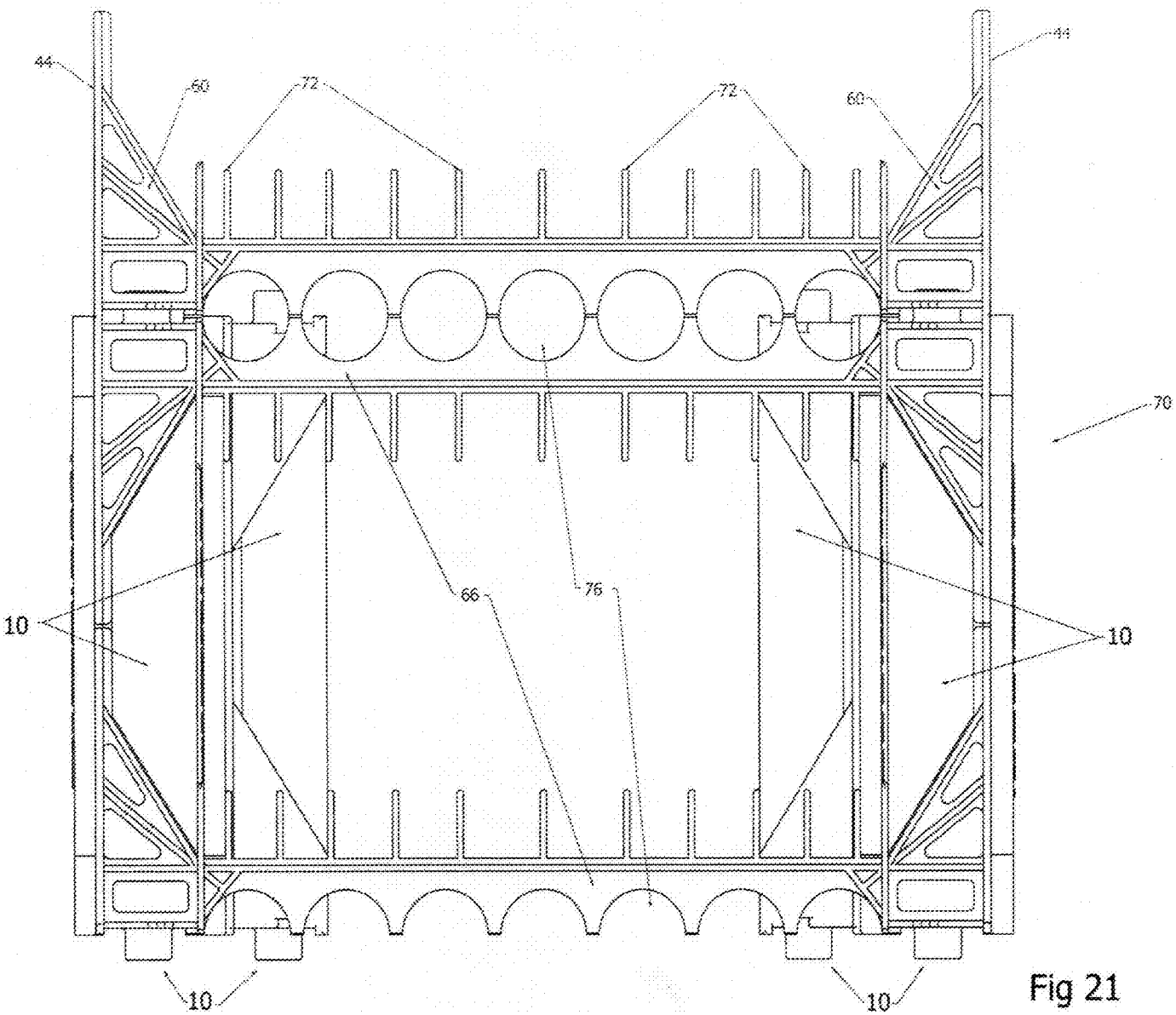
FIG. 21 is an end view of a multi-thickness insulating concrete form according to an illustrative embodiment of the present disclosure with half-ties at bottom end of construction panel.

According to another illustrative embodiment of the present disclosure, a multi-thickness form can be used to provide an additional layer of insulation, sound barrier, etc. For example, a single thickness form such as those described above may have a temperature transfer resistance (R-Value) of R22. A multi-thickness form may achieve an R-Value of at least up to R55. According to this illustrative embodiment, a multi-thickness form 70 as shown in FIGS. 19-21 is provided. The multi-thickness form is similar to the single thickness form described above but includes several additional features. As shown, multi-thickness form 70 includes additional layers of panels 10 placed directly behind an external layer of panels 10. Regularly spaced angular passages 36 and notches 37, 39 at the top end 20 and bottom end 22 of additional layers of construction panels 10 are adapted to fit over spacers 66 on ties 14. The same construction panels 10 may thus be used to make single or multiple thickness forms without a need to make any alterations to the construction panels 10 or ties 14.

Figure 22:
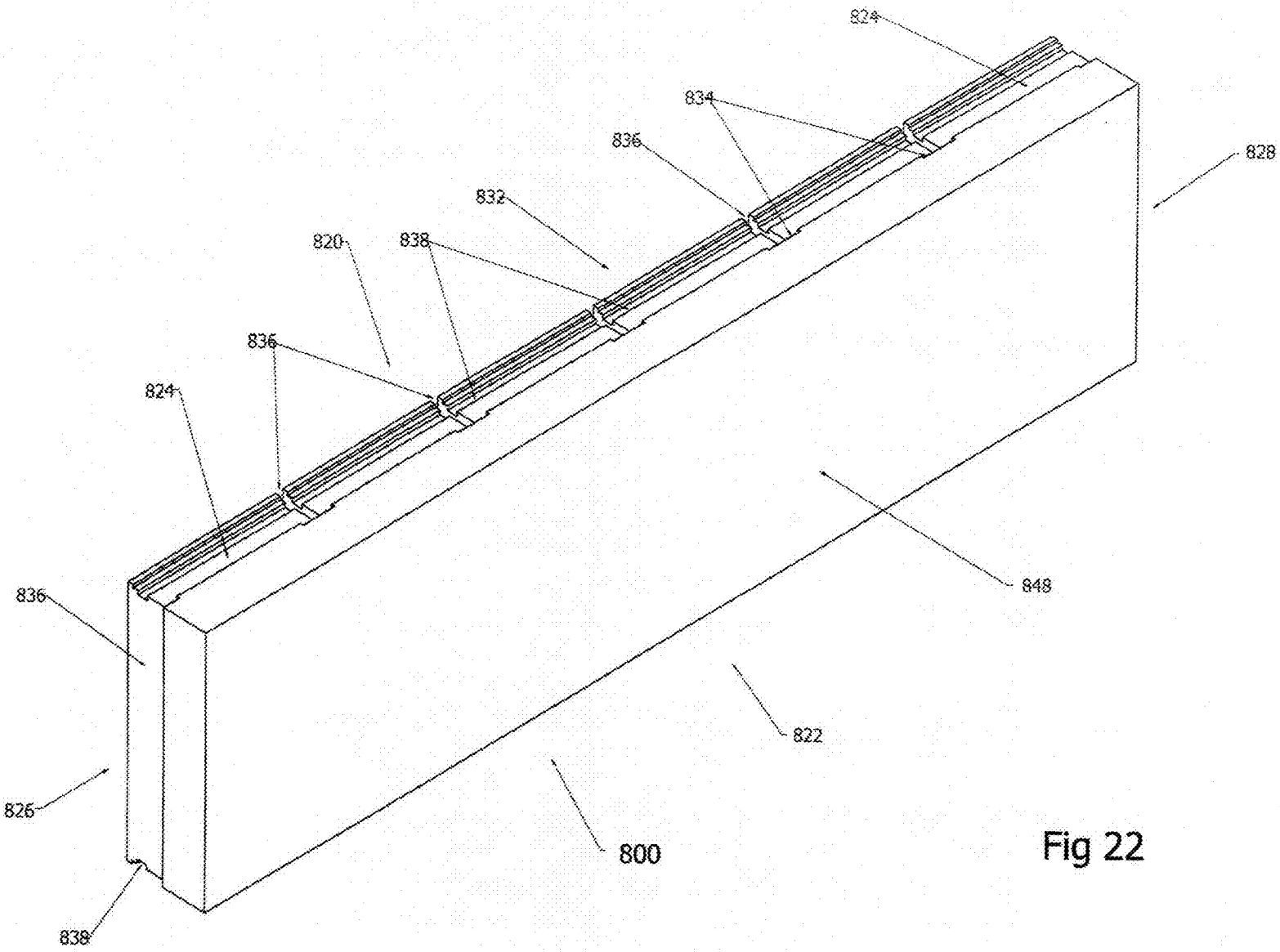
FIG. 22 is a perspective view of the front side of an insulating construction panel according to an illustrative embodiment of the present disclosure.
Figure 23:
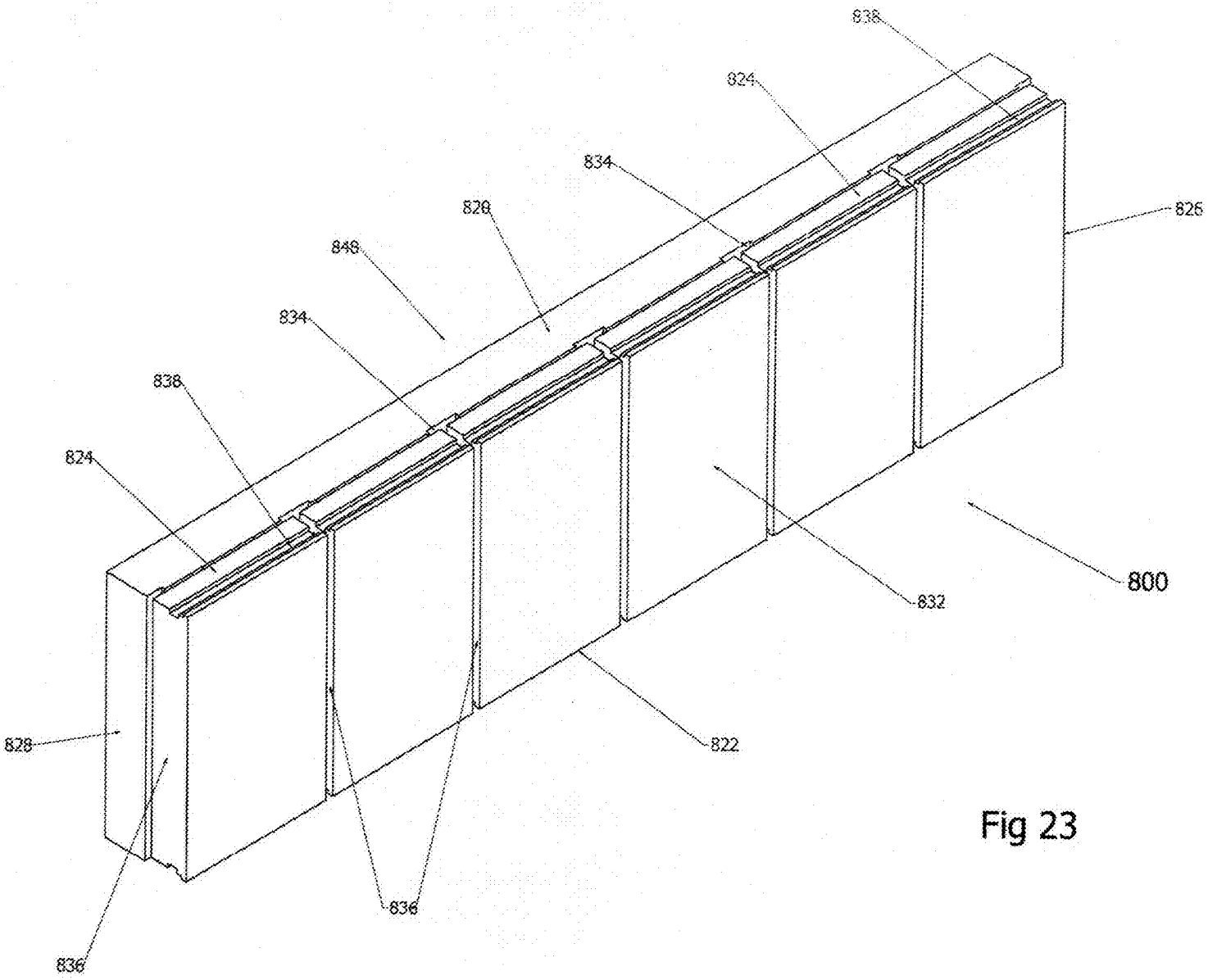
FIG. 23 is a perspective view of a rear side of the insulating construction panel according to an illustrative embodiment of the present disclosure.

FIGS. 22 and 23 illustrate perspective views of a front side 848 and a rear side 832, respectively, of an insulating construction panel 800 according to another illustrative embodiment of the present disclosure. According to the following illustrative embodiments of the present disclosure, construction panels 800 may be made with other types of material including but not limited to, for example, fire proof material such as aerated autoclaved concrete. Due to the different manufacturing process, construction panels 800 may be made with or without recesses 16, projections 18, drainage grooves 30, horizontal marking 46, and vertical grooves or markings 88 as described above with respect to other illustrative embodiments. According to this illustrative embodiment, angular passages 836 may extend from the top end 820 to the bottom end 822 and through the entire height of rear side 832 of panel 800. Small recess 838 may extend from first end 826 through the second end 828 at the top end 820 and bottom end 822 of construction panel 800.

Figure 24:
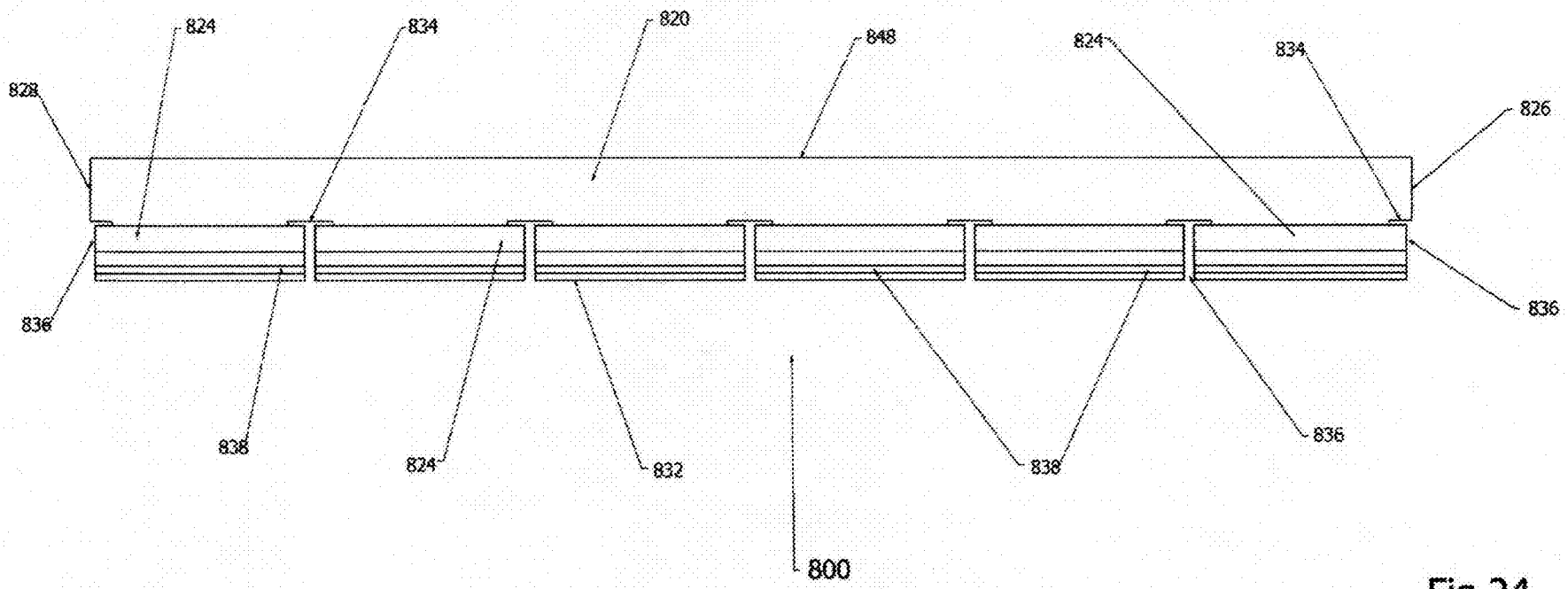
FIG. 24 is a top end or bottom end plan view of a construction panel according to an illustrative embodiment of the present disclosure.
Figure 25:
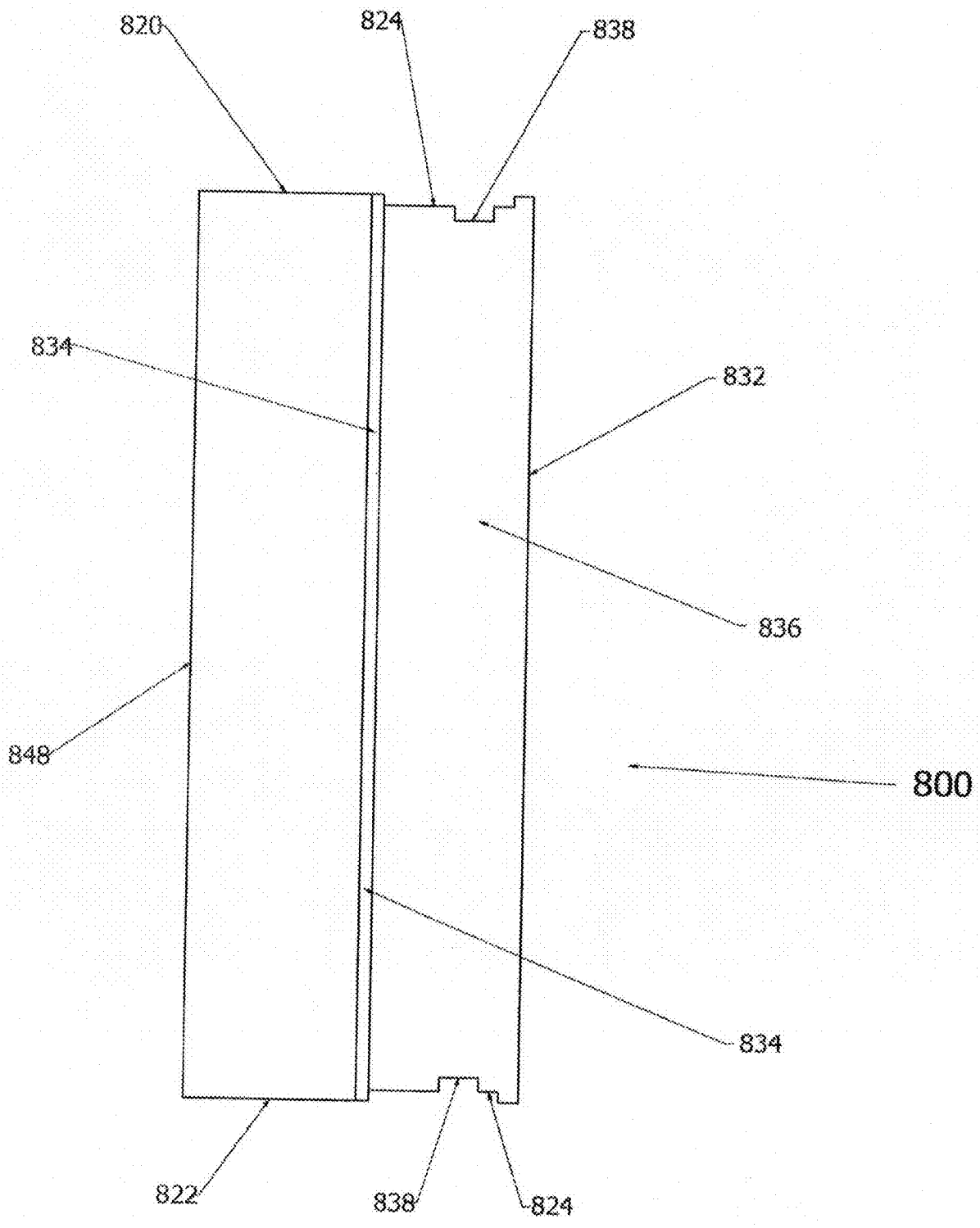
FIG. 25 is an end view of a construction panel according to an illustrative embodiment of the present disclosure.

As shown in more detail in FIGS. 24 and 25, according to an illustrative embodiment of the present disclosure, top end 820 and bottom end 822 include flat shaped recesses 824. The flat-shaped recesses 824 extend from first end 826 of panel 800 to the second end 828 of panel 800. The top end 820 does not include alternating projections and recesses as shown and described above with respect to other illustrative embodiments. Regularly spaced coplanar passages 834 extend through the panel 800 from the top end 820 to the bottom end 822. For each coplanar passage 834 there is one perpendicularly intersecting passage 836 extending from the top end 820 and bottom end 822 and through to rear side 832. Small recesses 838 are located within the flat shaped recesses 824 and extend from first end 826 of panel 800 to the second end 828 of panel 800. According to various illustrative embodiments of the present disclosure, concrete construction forms may be assembled utilizing just insulating construction panels 10 or tire proof construction panels 800 or any combination of the above-described construction panels. For example, according to illustrative embodiments of the present disclosure illustrated in FIGS. 26-30, a concrete construction form may be assembled utilizing insulating construction panels 10 on one side and fire proof construction panels 800 on the other side. Of course, the concrete construction form may be assembled utilizing fire proof construction panels 800 on both sides of the form if desired.

Figure 26:
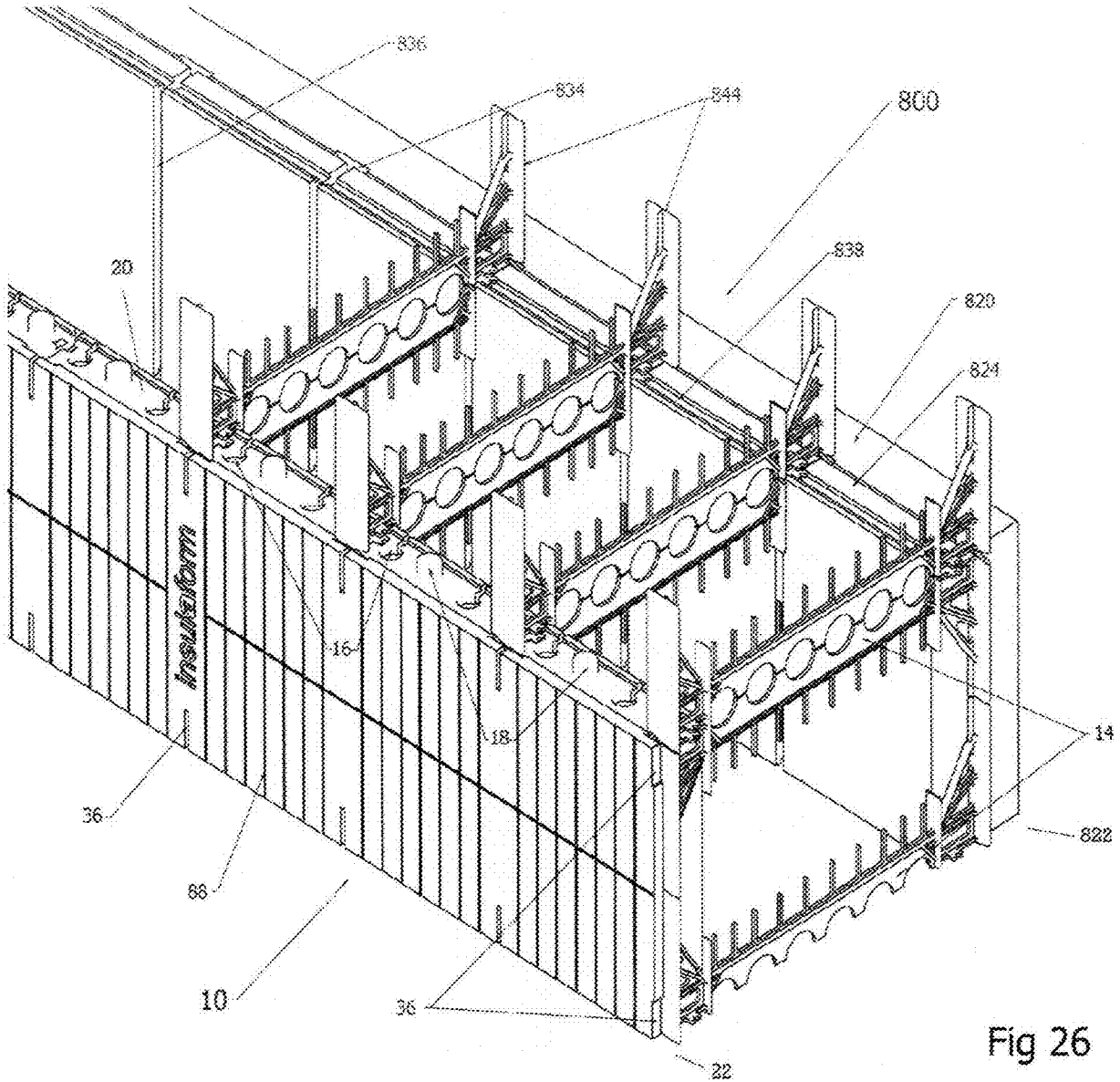
FIG. 26 is a fragmental perspective view of an concrete form including one type of insulating construction panels on one side and a different type of insulating construction panels on the other side according to an illustrative embodiment of the present disclosure.

FIG. 26 illustrates portions of an insulating construction panel 10 and a fire proof construction panel 800 interlocked with a plurality of insertable ties 14 at the top end 20 of insulating construction panel 10 and a top end 820 of fire proof construction panel 800 and a plurality of half-ties of the insertable ties 14 at the bottom end 22 of insulating construction panel 10 and the bottom end 822 of fire proof construction panel 800 according to an illustrative embodiment of the present disclosure. The ties 14 hold panels 10 and 800 in a fixed spaced parallel relationship, thereby defining the cavity dimension of the concrete form. As described above, insulating construction panels 10 are adapted to be stacked and interlocked with other like panels by the plurality of ties 14, recesses 16 and projections 18 in a bi-directional and/or reversible manner. Vertical grooves or markings 88 provide references for indicating location of the elongated plates 44 and aid in measuring and evenly cutting the panels 10. Plates 44 make secure attachment points for nails, screws, etc. used for mounting finishing materials to the face of panels 10. Fire proof construction panels 800 are adapted to be stacked and interlocked with other like panels by the plurality of ties 14 in a bi-directional and/or reversible manner.

Figure 27:
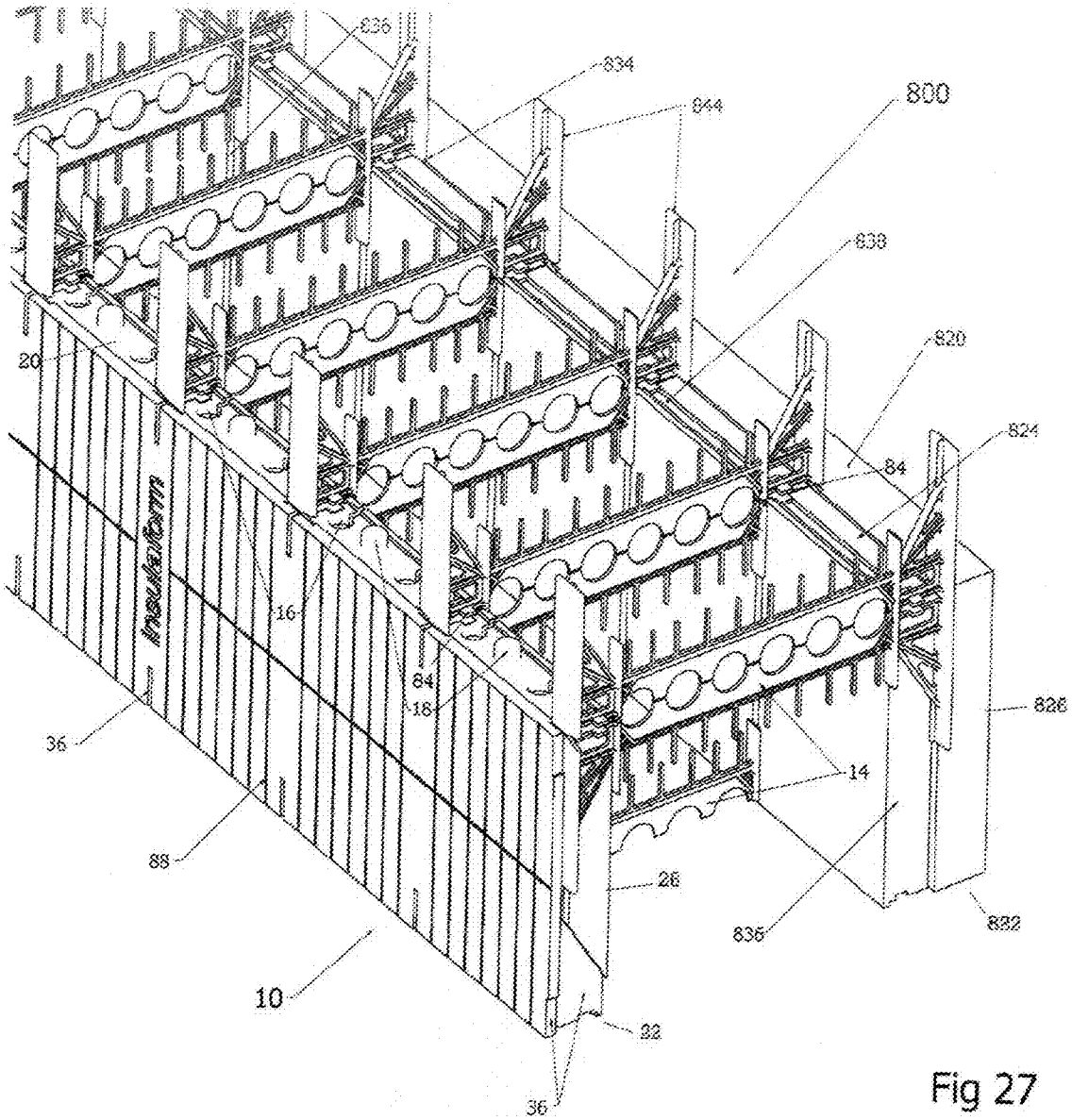
FIG. 27 is a fragmental perspective view of an insulating concrete form according to an illustrative embodiment of the present disclosure showing the ends of panels with an insertable tie.

FIG. 27 illustrates portions of an insulating construction panel 10 and a fire proof construction panel 800 interlocked with a plurality of insertable ties 14 at the top end 20 of insulating construction panel 10 and a top end 820 of fire proof construction panel 800 and a plurality of half-ties of the insertable ties 14 at the bottom end 22 of insulating construction panel 10 and the bottom end 822 of fire proof construction panel 800 according to an illustrative embodiment of the present disclosure. The ties 14 have been removed from end 26 of construction panel 10 and end 826 of fire proof construction panel 800 for ease of viewing. Screws, nails, etc. can be driven through tabs 84 and into flat-shaped molding 56 (not shown) to hold ties 14 in place against insulating construction panels 10 and/or fire proof construction panel 800 if desired.

Figure 28B:
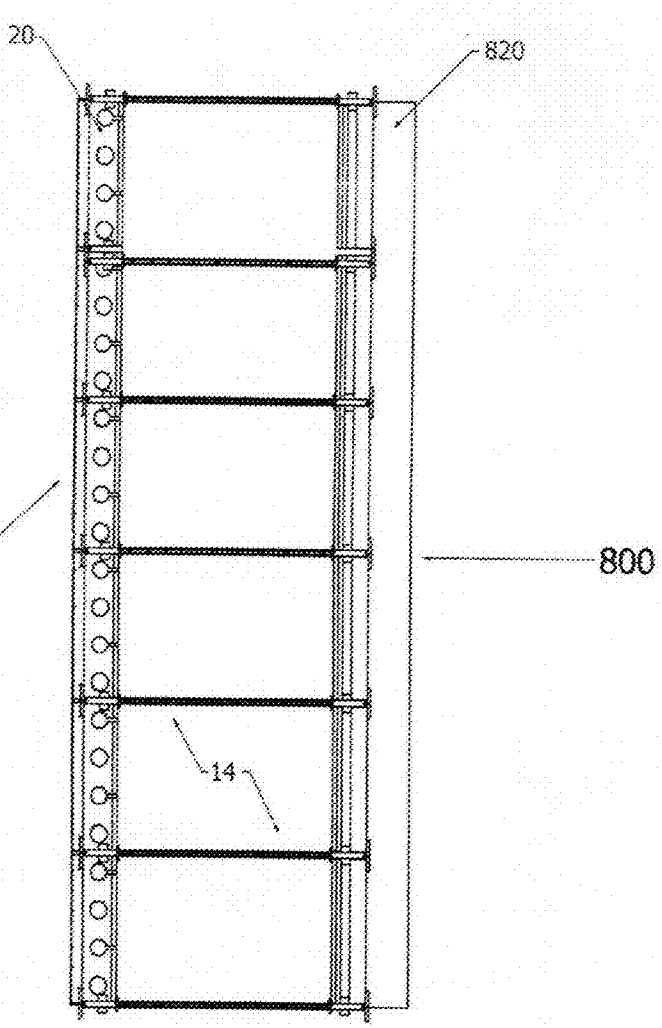
FIGS. 28A and 28B are top end and bottom end plan views, respectively, of the insulating concrete form of FIG. 26 according to an illustrative embodiment of the present disclosure.
Figure 28A:
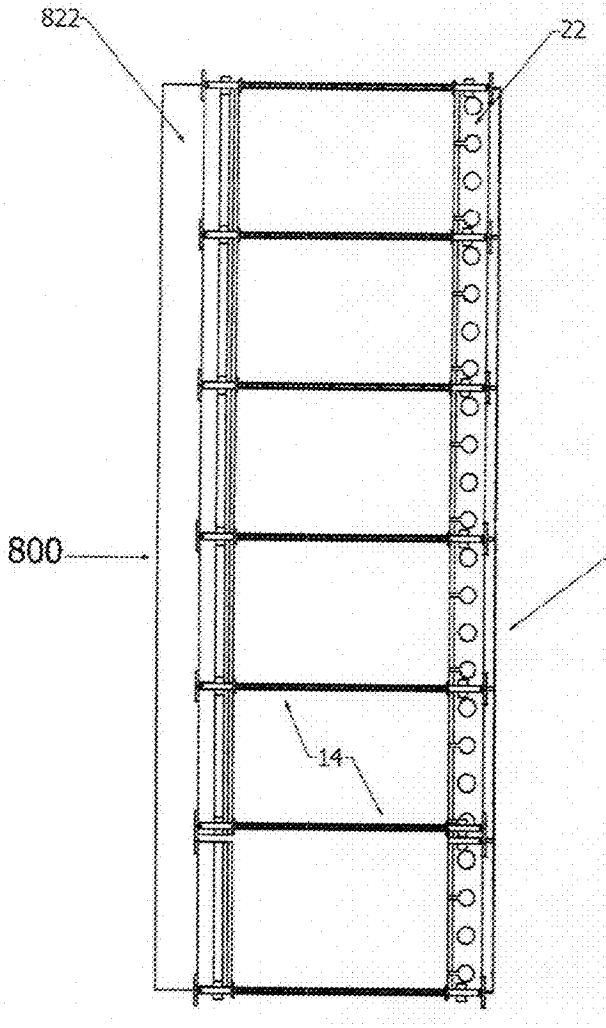

FIGS. 28A and 28B illustrate an insulating construction panel 10 and a fire proof construction panel 800 interlocked with a plurality of insertable ties 14 at the bottom end 22 of insulating construction panel 10 and the bottom end 822 of fire proof construction panel 800 (FIG. 28A) and the top end 20 of insulating construction panel 10 and the top end 820 of fire proof construction panel 800 (FIG. 28B) according to an illustrative embodiment of the present disclosure.

Figure 29:
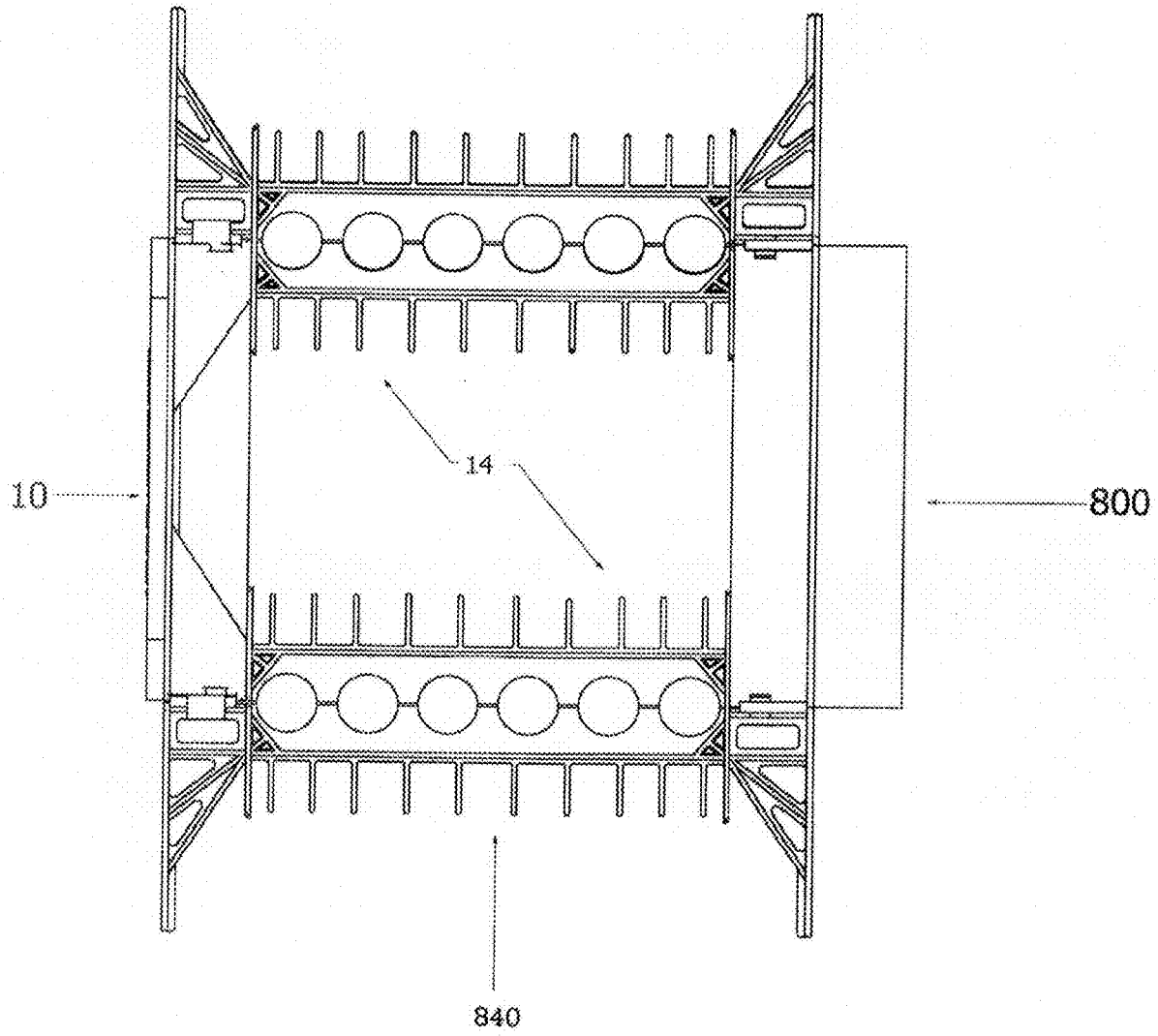
FIG. 29 is an end view of an assembled insulating concrete form according to an illustrative embodiment of the present disclosure with tie removed from the end of form.
Figure 30:
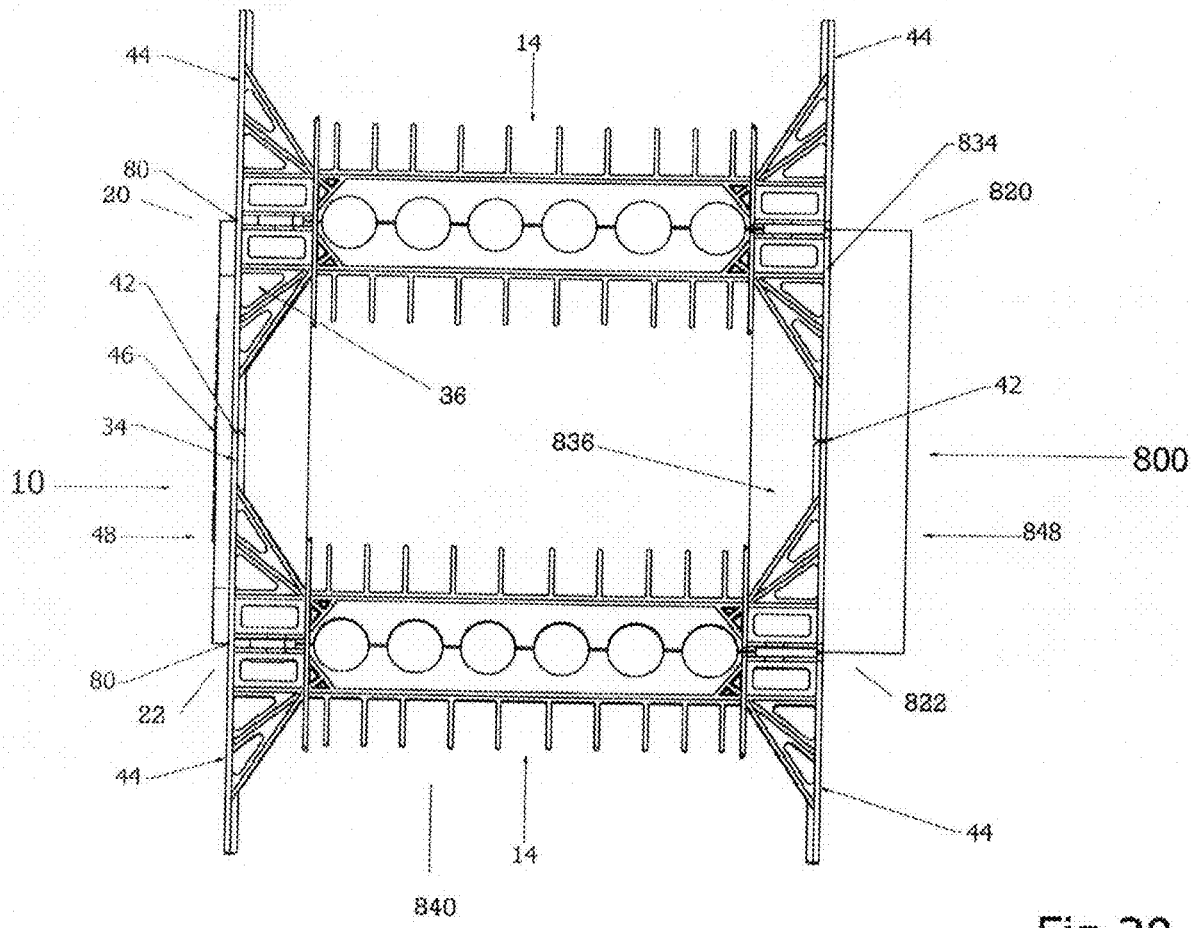
FIG. 30 is an end view of an assembled insulating concrete form according to an illustrative embodiment of the present disclosure showing full ties.

FIGS. 29 and 30 illustrate end views of the assembled single thickness concrete form 840 including an insulating construction panel 10 and a fire proof construction panel 800 according to an illustrative embodiment of the present disclosure. The form 840 includes opposing construction panel 10 and fire proof construction panel 800 interlocked with a plurality of insertable ties 14. Ties 14 are inserted into coplanar passages 34 and 834 and angular passages 36 and 836 at the top ends 20 and 820 and bottom ends 22 and 822 of insulating construction panels 10 and fire proof construction panels 800. There are small gaps 42 between elongated plates 44 for easy cutting and utility installation in construction panels 10. Continuous horizontal marking 46 at front side 48 of construction panel 10 indicate a best location for horizontal grooving and installation of utilities.

Illustrative embodiments of the present disclosure provide several salient features. For example, according to illustrative embodiments of the present disclosure, it is not necessary to mold webs, spacers, or ties into the insulating construction panels which results in lower labor costs during production. Since the ties are not permanently embedded in the insulating construction panels, tie scraps can be easily recycled. In addition, because the insulating construction panels can be manufactured from only one type of material, recycling of scraps is easier, less expensive, and improves "Green Building" practice. The present system is comprised of only three components: insulating construction panels 10 (and/or fire proof construction panels 800), ties 14 and flat moldings 56. This allows the components to be packed and shipped using less volume than those using pre-molded forms and corner panels, thus providing savings on storage, shipping and handling.

In addition, all of the insulating construction panels are interlocked by vertically lined up ties which cannot shift, therefore providing a reliable location for attaching finishing materials. The horizontal utility installation spot is located in the center of the insulating construction panels, away from ties and concrete which, in prior systems, would get in between panels during the concrete pour. This makes installation of utilities easier and results in fewer damaged tools that would otherwise be damaged by contact with stray concrete.

The pins 72 in the ties 14 greatly improve installation and removal of reinforcing bars or tools like chalk line or measuring tape. Pins 72 also aid in installing and holding additional layers of panels 10 in the desired position during assembly of multiple thickness forms.

Since the insulating construction panels can be made from a single component, many different materials can be used to make them. For example, foam panels provide excellent insulating volume. In addition, autoclaved aerated concrete panels provide great fire protection. Panels with a finishing surface can be used on one side to provide finished elevation without installation of additional materials. A combination of different panels can be used with multi-thickness forms to, for example, provide fire resistant panels on one side, insulating panels on the inner layer and finishing panels on the other side. Of course, the use of other combinations and/or types of materials is contemplated by the present disclosure.

What is claimed is:

1. An insulated construction panel having a top end, a bottom end, a first end, a second end, a front side and a rear side, the panel for constructing a single or multi-thickness concrete form, the panel comprising:

regularly spaced coplanar passages extending internally completely through the panel from the top end of the panel toward and through to the bottom end of the panel;

for each of the regularly spaced coplanar passages, an angular passage perpendicularly intersecting each coplanar passage at the top end and extending toward and through a portion of a front side surface of the front side and rear side surface of the rear side of the panel, each angular passage extending only partially through the panel from the top end toward the bottom end;

for each of the regularly spaced coplanar passages, an angular passage perpendicularly intersecting each coplanar passage at the bottom end and extending toward and through a portion of the front side surface of the front side and the rear side surface of rear side of the panel, each angular passage extending only partially through the panel from the bottom end toward the top end;

an insertable tie for interlocking a plurality of the insulating construction panels, the regularly spaced coplanar passages removably receiving the insertable tie for interlocking a plurality of the insulating construction panels to construct single thickness concrete forms comprising a pair of adjacent external layers of panels in a spaced relationship and multi-thickness concrete forms comprising a second pair of adjacent internal layers of panels, each of the second pair of adjacent internal layers of panels placed directly behind and abutting a corresponding one of the external layers of panels, the insertable tie further comprising V-shaped notches allowing the insertable tie to be split by hand without the use of cutting tools.

2. The construction panel of claim 1, further comprising:

a plurality of alternating similarly dimensioned projections and recesses on both the top end and bottom end; and drainage grooves provided on at least one of the top end and bottom end of the panel, the drainage grooves extending from the recesses through at least one of the rear side and front side of the panel.

3. The insulated construction panel of claim 2, further comprising a continuous horizontal marking centrally located between the top end and bottom end of construction panel.

4. The insulated construction panel of claim 3, wherein the continuous horizontal marking extends along the front end of construction panel from the first end to the second end for the purpose of marking space between elongated plates for convenient cutting and utility installation.

5. The insulated construction panel of claim 1, further comprising:

a groove on at least one of the top end and bottom end of the panel extending from the first end to the second end of the panel for receiving a flat-shaped molding; and a plurality of recesses to receive tabs from tie connectors on at least one side of the angular passages on the top end and the bottom end of the panel.

6. The insulated construction panel of claim 1, wherein the insulated construction panel comprises a foam insulating material.

7. The insulated construction panel of claim 1, wherein the insertable tie comprises:

two or more elongated plates, the elongated plates including horizontal center marks on an outside face of the elongated plates;

at least one angular connector, perpendicularly intersecting each of the two or more elongated plates; and at least one spacer joining the angular connectors.

8. The insulated construction panel as recited in claim 7, the tie further comprising:

flat-shaped passages centrally provided through the at least one angular connector for receiving a flat-shaped corner reinforcing molding; and tabs extending perpendicularly from both sides of the at least one angular connector and including a notch to receive a pin to secure the flat-shaped moldings corner reinforcing molding.

9. The insulated construction panel as recited in claim 7, the tie further comprising:

at least one perpendicular stopper provided on each spacer between spacer and angular connector at each end to keep panels in place; and at least one regularly spaced pin on at least one of a top and a bottom of the spacer, the at least one regularly spaced pin allowing uniform placement of horizontal reinforcement bars.

10. The insulated construction panel as recited in claim 9, wherein the at least one regularly spaced pin is designed for easy removal of construction tools and materials.

11. The insulated construction panel as recited in claim 7, further comprising:

a continuous horizontal marking along a center of the at least one spacer extending between the perpendicular stoppers to mark cutting location for splitting ties into two even halves.

12. The insulated construction panel as recited in claim 7, wherein the two or more elongated plates are insertable into the regularly spaced coplanar passages of two or more parallel arranged construction panels to maintain the panels a predetermined distance apart to form a space into which concrete can be poured, wherein the two or more elongated plates provide a suitable structure into which connectors can be driven and secured when attaching finishing materials to a face of the two or more elongated plates.

13. The insulated construction panel as recited in claim 2, wherein the panels are assembled such that the projections and recesses of one panel mate with corresponding recesses and projections of another panel.

14. A fire proof construction panel for constructing a single or multi-thickness concrete form, the panel comprising:

regularly spaced coplanar passages extending internally completely through the panel from a top end of the panel toward and through to a bottom end of the panel;

for each of the regularly spaced coplanar passages, an angular passage perpendicularly intersecting each coplanar passage at the top end and extending toward and through a front side and a portion of a rear side surface of a rear side of the panel, each angular passage extending only partially through the panel from the top end toward the bottom end;

for each of the regularly spaced coplanar passages, an angular passage perpendicularly intersecting each coplanar passage at the bottom end and extending toward and through the front side and a portion of the rear side surface of rear side of the panel, each angular passage extending only partially through the panel from the bottom end toward the top end; and an insertable tie for interlocking a plurality of the construction panels, the regularly spaced coplanar passages removably receiving the insertable tie for interlocking a plurality of the construction panels to construct single thickness concrete forms comprising a pair of adjacent external layers of panels in a spaced relationship and multi-thickness concrete forms comprising a second pair of adjacent internal layers of panels, each of the second pair of adjacent internal layers of panels placed directly behind and abutting a corresponding one of the external layers of panels, the insertable tie further comprising V-shaped notches allowing the insertable tie to be split by hand without the use of cutting tools.

15. The panel as recited in claim 14, wherein the fire proof construction panel is formed from a fire proof material.

16. The panel as recited in claim 15, wherein the fire proof material comprises an aerated autoclaved concrete material.

17. A concrete form system comprising:

a plurality of construction panels, each comprising regularly spaced coplanar passages extending internally completely through the panel from the top end of the panel toward and through to the bottom end of the panel;

a removably insertable tie for interconnecting the plurality of construction panels; and a flat-shaped molding for interlocking the plurality of construction panels.

18. The concrete form system as recited in claim 17, wherein the plurality of construction panels comprise insulated construction panels.

19. The concrete form system as recited in claim 17, wherein the plurality of construction panels comprise fire proof construction panels.

20. The concrete form system as recited n claim 17, wherein the plurality of construction panels comprise at least one of an insulated construction panel and a fire proof construction panel.

* * * * *